US005260176A

United States Patent [19]

Otani et al.

[11] Patent Number: 5,260,176

[45] Date of Patent: * Nov. 9, 1993

[54] METHOD OF FORMING A COLOR IMAGE

[75] Inventors: Shigeaki Otani; Yoji Okazaki, both of Kanagawa, Japan

[73] Assignee: Fuji Photo Film Co., Ltd., Kanagawa, Japan

[ * ] Notice: The portion of the term of this patent subsequent to Oct. 6, 2009 has been disclaimed.

[21] Appl. No.: 817,958

[22] Filed: Jan. 8, 1992

Related U.S. Application Data

[63] Continuation of Ser. No. 376,054, Jul. 6, 1989, abandoned.

[30] Foreign Application Priority Data

Jul. 6, 1988 [JP] Japan ..... 63-168289
Feb. 10, 1989 [JP] Japan ..... 1-29976

[51] Int. Cl.[5] ..... G03C 7/30; G03C 7/32

[52] U.S. Cl. ..... 430/363; 430/375; 430/377; 430/399; 430/550; 430/567; 430/604; 430/944

[58] Field of Search ..... 430/363, 377, 550, 399, 430/375, 376, 944, 604, 567

[56] References Cited

U.S. PATENT DOCUMENTS

| | | | |
|---|---|---|---|
| T877,006 | 8/1970 | Marchant et al. | 430/94[illegible] |
| 4,770,978 | 9/1988 | Matsuzaka et al. | 430/363 |
| 4,797,351 | 1/1989 | Ishikawa et al. | 430/387 |
| 4,801,516 | 1/1989 | Ishikawa et al. | 430/380 |
| 4,828,962 | 5/1989 | Grzeskowiak et al. | 430/604 |
| 4,849,324 | 7/1989 | Aida et al. | 430/445 |
| 5,057,402 | 10/1991 | Shiba et al. | 430/377 |
| 5,153,110 | 10/1992 | Kawai et al. | 430/550 |

FOREIGN PATENT DOCUMENTS

| | | |
|---|---|---|
| 0230100 | 7/1987 | European Pat. Off. . |
| 0273430 | 7/1988 | European Pat. Off. . |
| 3707835 | 9/1987 | Fed. Rep. of Germany . |
| 2023299 | 12/1979 | United Kingdom . |

OTHER PUBLICATIONS

Patent Abst. of Japan, vol. 12, No. 129, p. 692(2976) Apr. 1988, Abst. of JP 62/251617-250121.
Pat. Abstr. of Japan, vol. 12, No. 361 (P-763)(3208) Sep. 1988, Abst. of JP 63/111403-113605.
Derwent Abst. JP 63/013345, Jan. 1988, Konishiroku.
Derwent Abst. JP 63/113534, May 1988, Fuji Photo.
Derwent Abstr. JP 63/106655, May 1988, Konishiroku.

*Primary Examiner*—Richard L. Schilling
*Attorney, Agent, or Firm*—Sughrue, Mion, Zinn, Macpeak & Seas

[57] ABSTRACT

A method of forming a color image on a silver halide color photographic light-sensitive material having at least one silver halide emulsion layer provided on a reflective support, which does not substantially contain silver iodide and which contains silver chlorobromide or silver chloride grains having a silver chloride content of at least 95 mol %, said grains containing at least one metal ion consisting of a group of ions of metals of Group VIII of the Periodic Table, transition metals of Group II of the Periodic Table, lead and thallium in an amount of at least $10^{-9}$ mol per mol of silver halide, comprising exposing said photographic material by means of a scanning exposure using an image signal formed by scanning an original image and thereafter continuously processing said photographic material with a color developer substantially not containing benzyl alcohol, wherein the amount of the replenisher to the developer is 200 ml or less per $m^2$ of the photographic material processed thereby. The variation in the photographic properties of the material thus continuously processed, is greatly reduced.

16 Claims, No Drawings

METHOD OF FORMING A COLOR IMAGE

This is a continuation of application Ser. No. 07/376,054 filed Jul. 6, 1989 now abandoned.

FIELD OF THE INVENTION

The present invention relates to a method of forming a color image using a silver halide color photographic light-sensitive material and, more particularly, to a method wherein a silver halide color photographic light-sensitive material, after being subjected to a scanning exposure, is continuously processed with a color developer substantially not containing benzyl alcohol in a development system wherein the amount of the replenisher to the color developer is reduced. Using the method of the present invention, variation in the the photographic properties of the material processed at a beginning of the processing cycle and that processed at the end thereof is minimized.

BACKGROUND OF THE INVENTION

A scanner system may be used to form an image by scanning exposure. Various practical scanner system recording apparatus are known. A glow lamp, xenone lamp, mercury lamp, tungsten lamp or light-emitting diode has heretofore been used as a light source for the apparatus. However, these light source are disadvantageous in practical use, as the output power is weak and the life of the light source is short. In order to overcome these drawbacks, use of a coherent laser source, such as Ne-He laser, argon laser, He-Cd laser or the like gas laser or semiconductor laser, as a light source for a scanner system recording apparatus, has hitherto been proposed.

However, gas lasers also have some drawbacks. The device is large-scaled and expensive, and requires a modulating means.

On the other hand, the device for generating a semiconductor laser is advantageously small-sized and inexpensive and can be easily modulated. Further, the operating life of a semiconductor laser is longer than that of a gas laser. The wavelength of the light emitted from the semiconductor laser is mainly in the infrared range, and therefore, photographic materials to be exposed with a semiconductor laser preferably have a high sensitivity in the infrared range. However, such infrared-sensitive photographic materials have poor storage properties because the infrared sensitizing dye therein is unstable, and the manufacture and handling of such materials is therefore difficult. Thus, a method of forming an image by means of a scanning exposure of a silver halide photographic material spectrally sensitized with a stable spectral sensitizing dye functioning in the visible range, while the merits of the semiconductor are kept, has been desired.

As one example of such a method, JP-A-63-113534 (the term "JP-A" as used herein means an "unexamined published Japanese patent application") illustrates a method of using, as a light source, the secondary higher harmonics obtained by the combination of a laser and a wavelength-converting element made of a nonlinear optical material. However, the use of such a light source is considerably restricted. Specifically, the wavelength range of the secondary higher harmonics thus obtained is limited since the usable wavelength range of the laser is limited. Therefore, a wavelength that is most favorable from the viewpoint of color reproducibility cannot be selected.

In order to overcome the above problem, JP-A-63-8345 has proposed a method of using silver halide grains having a high silver chloride content in the green-sensitive and red-sensitive layer of the photo graphic material.

Further, silver halide grains having a high silver chloride content are desirable for rapid processability of photographic materials.

On the other hand, the addition of benzyl alcohol to color developing solutions has widely been utilized for the purpose of accelerating coloration of photographic materials. However, since benzyl alcohol and solvents thereof, such as diethylene glycol, triethylene glycol and alkanolamines, have high BOD and COD values (environmental pollution load values), benzyl alcohol is desirably not used in the color developer for the purpose of minimizing the environmental pollution load. In addition, reduction of the replenisher amount to the color developer is also highly desirable from the view point of economization of natural resources and the prevention of environmental pollution. Means of reducing color developer replenisher amount have been proposed in JP A-61-70522 and JP-A-63-106655.

In view of the above-noted demand, the present inventors have endeavored to perfect a method of exposing a color photographic material containing silver chloride rich silver halide grains by a scanning exposure and thereafter continuously processing the exposed material with a color developer substantially not containing benzyl alcohol, and using a reduced amount of replenisher thereto. As a result, the present inventors have found that the photographic properties of the thus processed materials noticeably vary between the material processed at the beginning of the continuous process and the material processed at the end thereof. The variation in photographic properties impairs the quality of finished color prints. The present inventors have also found that the extent of variation depends on the amount of the color development replenisher used in continuous processing. In particular, variation of the photographic properties was found to be extremely noticeable in color photographic materials containing a silver chloride-rich surface latent image-type emulsion.

On the other hand, a silver chloride-rich silver halide emulsion is known to be easily fogged. In addition, it is also known that conventional chemical sensitization hardly imparts high sensitivity to such emulsions and that reciprocity law failure often occurs. Thus, the sensitivity and gradation varies considerably with the exposure intensity. That is, the use of silver chloride-rich silver halide emulsions are known to have the above-noted shortcomings. In order to overcome the drawbacks, various techniques have heretofore been proposed.

For example, JP-A-58-95736, JP-A-58-108533, JP-A-60 222844 and JP-A-60-222845 describe a structure of a composite silver halide grain having a silver bromide-rich layer. JP-A-51-139323 and JP-A-59-171947 and British Patent 2,109,576A describe the incorporation of a compound of a metal of Group VIII of the Periodic Table into the silver halide grains.

In particular, incorporation of a rhodium compound or an iridium compound into the silver halide grains is disclosed in JP-B-49-33781 (the term "JP-B" as used herein means an "examined Japanese patent publication") and JP-A-50 23618, JP-A-52-18310, JP-A 56-125734, JP-A-58-15952, JP-A-59-214028, JP-A 61-47941 and JP A-61-67845, West German Patent Application (OLS) Nos. 2,226,877 and 2,708,466 and U.S. Pat. No. 3,703,584.

However, none of the above publications recognize the problem of variation in the photographic properties of the photographic material as exposed by means of a high intensity scanning exposure source as described above, and thereafter continuously processed with a color development system substantially not containing benzyl alcohol, using a reduced amount of replenisher.

In order to overcome the above-noted problems, the present inventors have found that the incorporation of a certain type of metal ion into the silver chlorobromide grains of the photographic material overcomes the problems, thus resulting in the present invention.

SUMMARY OF THE INVENTION

The object of the present invention is to provide a method of forming a color image, in which a silver halide color photographic material, after being exposed by scanning exposure, is processed with a substantially benzyl alcohol-free development system using a reduced amount of replenisher, such that variation in the photographic properties of the finished color prints is small even when the amount of the photographic material to be processed in the continuous processing varies.

The object of the present invention has been attained by a method of forming a color image on a silver halide color photographic material having at least one silver halide emulsion layer provided on a reflective support, which does not substantially contain silver iodide and which contains silver chlorobromide or silver chloride grains having a silver chloride content of at least 95 mol %, containing at least one metal ion selected from ion metals of Group VIII of the Periodic Table, transition metals of Group II of the Periodic Table, lead and thallium in an amount of at least $10^{-9}$ mol per mol of silver halide, comprising exposing said photographic material by means of a scanning exposure using an image signal formed by scanning an original image and thereafter continuously processing said photographic material with a color developer substantially not containing benzyl alcohol, wherein the amount of the replenisher to the color developer is 200 ml or less per $m^2$ of the photographic material being processed.

DETAILED DESCRIPTION OF THE INVENTION

The present invention is explained in detail below as follows.

The silver halide emulsion for use in the present invention contains grains preferably having a mean grain size of from 0.1 μm to 2 μm, more preferably from 0.2 μm to 1.3 μm, given as the diameter of a projected equivalent circle. More preferably, the emulsion is a monodispersed emulsion. Specifically, the emulsion has a grain size distribution coefficient of variation, which indicates the degree of monodispersion and which is represented by the ratio of the statistical standard deviation (S) to the mean grain size ($\bar{d}$), of 0.2 or less, more preferably 0.15 or less. When a mixture of two or more kinds of silver halide emulsions is used, at least one of the emulsions (which occupies 50 wt % or more) preferably has a coefficient of variation satisfying the above criteria. More preferably, the mixed emulsion has a coefficient of variation which satisfies those criteria.

The silver halide grains for use in the present invention may have different phases present between the inside and the surface layer of the individual grains, or may have a multi-phase structure comprising a junction structure or may have a uniform phase throughout the whole grain. The emulsion of the present invention may contain grains which individually have different grain structures.

The silver halide grains for use in the method of the present invention are silver chlorobromide or silver chloride grains which do not substantially contain silver iodide and which have a silver chloride content of at least 95 mol %. The grains "which do not substantially contain silver iodide" means those grains having a silver iodide content of 2 mol % or less, preferably 1 mol % or less. Most preferably, the grains do not contain silver iodide at all. The silver chloride content of the grains is preferably 98 mol % or more. The silver chlorobromide grains for use in the present invention preferably have a silver bromide-locallized phase near at least one apex of the grain.

The silver bromide content of the above-noted silver bromide-locallized phase is from 10 to 70 mol %, more preferably from 15 to 70 mol %, and the balance is silver chloride The wording "near the apex" of the silver halide grain as referred to herein indicates the inside of the area of a square, the side of which preferably has a length of about ⅓, more preferably 1/5, of the diameter of the circle having the same area as the projected area of the silver chlorobromide grain and the angle of which corresponds to the apex of the grain (or the intersection point of the edges of a normal crystal grain which is cubic or is regarded as being cubic). The silver bromide content of silver chlorobromide grains having a silver bromide localized phase in the emulsion is preferably 70 mol % or more of the total silver halide grains in the same emulsion. More preferably, it is 90 mol % or more. The method of forming silver chlorobromide grains having a silver bromide-locallized phase near the apex of the grain as well as the method of determining the position of the silver bromide-locallized phase and the halide composition of the said locallized phase are described, for example, in European Patent 0,273,430.

The silver halide emulsion for use in the present invention may be either an internal latent image-type emulsion which forms a latent image mainly in the inside of the grains, or a so-called surface latent image-type emulsion which forms a latent image mainly on the surface of the grain. However, the effect of the present invention is more remarkable when a surface latent image-type emulsion is used, especially when a surface latent image-type silver chlorobromide emulsion having a silver bromide-locallized phase and having a silver chloride content of 98 mol % or more is used.

The silver halide grains for use in the present invention may have a regular crystalline form, such as a cubic, octahedral, dodecahedral or tetradecahedral crystalline form, or may have an irregular crystalline form, such as a spherical crystalline form. Further, the silver halide grains may have a composite crystalline form of these forms. The grains may be tabular grains. Specifically an emulsion containing tabular grains having ratio of the length to the thickness of 5 or more, especially 8 or more, in a proportion of 50% or more of the total projected area of the grains in the emulsion is preferably used. Further, an emulsion containing grains of different crystalline form in admixture may also be used.

In order to efficiently attain the effect of the present invention, the crystalline form of the silver halide grains in the emulsion is preferably cubic, tetradecahedral or octahedral.

The photographic emulsion for use in the present invention can be prepared by the methods described in P. Glafkides, *Chimie et Physique Photographique* (published by Paul Montel, 1967), G. F. Duffin, *Photographic Emulsion Chemistry* (published by Focal Press, 1966), and V. L. Zelikman et al, *Making and Coating Photographic Emulsion* (published by Focal Press, 1964). For example, the emulsion may be prepared by an acid method, neutralization method or ammonia method. The soluble silver salt and soluble halide(s) may be reacted using a single jet method, double jet method or combination thereof. A method of forming grains in the presence of excess silver ions (the reverse mixing method) can also be employed. The controlled double jet method is preferably used wherein the pAg value in the liquid phase forming the silver halide grains is held constant. A silver halide emulsion containing grains having a regular crystalline form and having a nearly uniform grain size can be obtained by this method.

The silver halide emulsion for use in the present invention, after the grains therein have been formed, is typically physically ripened, desalted and chemically ripened, and then the thus ripened emulsion is coated on a support.

Known silver halide solvents (for example, ammonia, potassium thiocyanate, as well as thioethers and thione compounds described in U.S. Pat. No. 3,271,157, JP-A-51-12360, JP-A-53-82408, JP-A-53-144319, JP-A 54-100717 and JP-A-54-155828) can be used in the step of precipitation, physical ripening or chemical ripening of the emulsion. In order to remove the soluble silver salts from the physically ripened emulsion, noodle washing, flocculation precipitation or ultrafiltration can be employed.

In the present invention the "metal ion" includes ions which can be derived from a metal salt or a metal complex salt (which provides a metal complex ion). In the present invention it is preferred to use a metal complex salt such as halogeno complex salt and a cyano complex salt.

The metal ion to be incorporated into the silver halide grains of the present invention includes metal ions derived from metals of Group VIII of the Periodic Table, such as iron, iridium, platinum, palladium, nickel, rhodium, osmium, ruthenium or cobalt; transition metals of Group II of the Periodic Table, such as cadmium, zinc or mercury, and lead and thallium. Any ion of a polyvalent metal may be used in the present invention. The metal ion may be an organic metal ion or an inorganic metal ion. Salts or complex salts containing a metal ion is preferably those which can be dissolved in a solvent (water, an organic solvent or a mixture thereof). Examples of counter ions and ligands which form the salts or the complex salts include those which can be seen in salts and complex salts shown as examples of compound containing such metal ions.

At least one of such metal ions is incorporated into the silver halide grains. In particular, transition metal ions such as iron, iridium, platinum, palladium, nickel and rhodium ions are especially preferred.

Non-limiting examples of compounds containing such metal ions include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albuminate, ammonium ferric acetate, ferric bromide, ferric chloride, ferric chlormate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidine ferric sulfate, ammonium ferric citrate, potassium hexacyano ferrate(II), potassium ferrous pentacyanoanmine, sodium ferric ethylenedinitrilotetraacetate, potassium hexacyanoferrate(III), ferric tris(dipyridyl) chloride, potassium ferric pentacyanonitrosyl, ferric hexaurea chloride, iridium(III) chloride, iridium(III) bromide, iridium(IV) chloride, sodium hexachloroiridate(III), potassium hexachloroiridate(IV), iridium(III) hexaanmine, iridium(IV) hexaanmine, iridium(III) trioxalate, iridium(IV) trioxalate, platinum(IV) chloride, potassium hexachloroplatinate(IV), tetrachloroplatinic(II) acid, tetrabromoplatinic(II) acid, sodium tetrakis(thiocyanato)-platinate(VI), hexaanmineplatinum(IV) chloride, sodium tetrachloropalladate(II), sodium tetrachloropalladate(IV), potassium hexachloropalladate(IV), tetraanmine palladium(II) chloride, potassium tetracyanopalladate(III), nickel chloride, nickel bromide, potassium tetrachloronickelate(II), hexaanminenickel(II) chloride, sodium tetracyanonickelate(II), potassium hexachlororhodate, sodium hexabromorhodate, ammonium hexachlororhodate.

In order to incorporate the metal ion into the localized phase and/or other grain moiety (substrate) of the silver halide grains of the present invention, the metal ion may be added to the emulsion before or during formation of the grains or during physical ripening of the emulsion. For example, the metal ion may be added to an aqueous gelatin solution, an aqueous halide solution, an aqueous silver salt solution or other aqueous solutions employed in the formation of the silver halide grains.

Alternatively, the metal ion may be incorporated into fine silver halide grains. The fine silver halide grains are then added to a host silver halide emulsion such that the fine silver halide grains are dissolved therein, thereby transferring the metal ion into the silver halide grains in the host emulsion. This method is effective in introducing a metal ion into a silver bromide-locallized phase present on the surface of silver halide grains. The method of adding the metal ion is selected depending on the position of the silver halide grains in which the metal ion is to be incorporated.

The content of the metal ion to be incorporated in the silver halide grains of the present invention is at least $10^{-9}$ mol per mol of silver halide, preferably, from $10^{-9}$ mol to $10^{-2}$ mol, and more preferably from $10^{-8}$ mol to $10^{-3}$ mol. When the metal ion is used in an excess amount, sensitivity tends to be low, preservability of a latent image tends to be deteriorated, and the photographic material becomes susceptible to pressure desensitizing.

The silver halide emulsion for use in the present invention can be sensitized by a sulfur sensitization method using a sulfur-containing compound capable of reacting with active gelatin or silver (for example, thiosulfates, thioureas, mercapto compounds, rhodanines); a reduction sensitization method using a reducing substance (for example, stannous salts, amines, hydrazine derivatives, formamidine-sulfinic acids, silane compounds), or a noble metal sensitization method using a metal compound (for example, gold complexes as well as complexes of metals of Group VIII of the Periodic Table such as Pt, Ir, Pd, Rh or Fe) or a combination of such methods.

Among the above-mentioned chemical sensitization methods, sulfur sensitization and/or gold sensitization is preferred, and single sulfur sensitization is particularly preferred for the emulsions of the present invention.

For good gradation of the color photographic material of the present invention, two or more monodispersed silver halide emulsions each having a different grain size (the monodispersion preferably has the above-defined coefficient of variation) are incorporated into one layer or are separately coated to form plural layers having substantially the same color-sensitivity. Further, two or more polydispersed emulsions or a mixture of a monodispersed emulsion and a polydispersed emulsion can also be used to form one layer or to form different, multiple layers.

The blue-sensitive, green-sensitive and red-sensitive silver halide emulsions of the present invention are preferably spectrally sensitized with methine dyes or the like to provide the requisite color-sensitivities. Dyes usable as spectral sensitizing dyes include cyanine dyes, merocyanine dyes, complex cyanine dyes, complex merocyanine dyes, holopolar cyanine dyes, hemicyanine dyes, styryl dyes and hemioxonole dyes. Especially useful dyes are cyanine dyes, merocyanine dyes and complex merocyanine dyes. Nuclei which are generally utilized in cyanine dyes as basic heterocyclic nuclei may be used in the above-noted dyes. Specifically, such nuclei include pyrroline nuclei, oxazoline nuclei, thiazoline nuclei, pyrrole nuclei, oxazole nuclei, thiazole nuclei, selenazole nuclei, imidazole nuclei, tetrazole nuclei and pyridine nuclei; nuclei formed by fusing alicyclic hydrocarbon rings to the said nuclei; and nuclei formed by fusing aromatic hydrocarbon rings to the nuclei, such as indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei and quinoline nuclei. The carbon atoms of the nuclei may be substituted.

Merocyanine dyes or complex merocyanine dyes may comprise, as a nucleus having a ketomethylene structure having 5 to 6-membered heterocyclic nuclei such as pyrazolin-5-one nuclei, thiohydantoin nuclei, 2-thioxazolidine-2,4-dione nuclei, thiazoline-2,4-dione nuclei, rhodanine nuclei and thiobarbituric acid nuclei.

The sensitizing dyes for use in the present invention can be used singly or in combination thereof, and a combination of sensitizing dyes is frequently used for supercolor sensitization. Examples of such combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Patents 1,344,281 and JP-B-53-12375, and JP-A-52-110618 and JP-A-52-109925.

Where a semiconductor laser is used as the light source for scanning exposure, it is preferred that at least one silver halide light-sensitive layer is spectral-sensitized in the wavelength range of anyone of from 660 to 690 nm, from 740 to 790 nm, from 800 to 850 nm and from 850 to 900 nm by the use of sensitizing dyes, preferably by using those represented by the following formulae (I), (II) and (III).

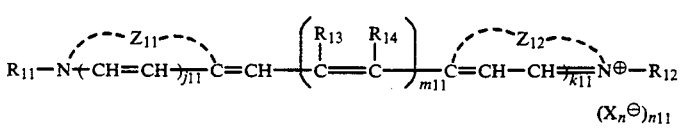

(I)

where $Z_{11}$ and $Z_{12}$ each represents an atomic group necessary for forming a heterocyclic nucleus.

The heterocyclic nucleus is preferably a 5-membered or 6-membered nucleus having, a hetero atom(s), nitrogen atom(s) and other optional sulfur, oxygen, selenium and/or tellurium atom(s), and the hetero-ring may optionally have a condensed ring as bonded thereto and may also have further substituent(s) thereon.

Examples of such heterocyclic nucleus include thiazole nucleus, benzothiazole nucleus, naphthothiazole nucleus, selenazole nucleus, benzoselenazole nucleus, naphthoselenazole nucleus, oxazole nucleus, benzoxazole nucleus, naphthoxazole nucleus, imidazole nucleus, benzimidazole nucleus, naphthoimidazole nucleus, 4-quinoline nucleus, pyrroline nucleus, pyridine nucleus, tetrazole nucleus, indolenine nucleus, benzindolenine nucleus, indole nucleus, tellurazole nucleus, benzotellurazole nucleus and naphthotellurazole nucleus.

$R_{11}$ and $R_{12}$ each represents an alkyl group, an alkenyl group, an alkynyl group or an aralkyl group. These groups and the groups which will be mentioned below include the corresponding substituted groups. For instance, in the case of the alkyl group, it may be unsubstituted or substituted and may also be linear, branched or cyclic. The alkyl group preferably has from 1 to 8 carbon atoms.

Examples of the substituents for the substituted alkyl group include a halogen atom (e.g., chlorine, bromine, fluorine), a cyano group, an alkoxy group, a substituted or unsubstituted amino group, a carboxylic acid group, a sulfonic acid group and a hydroxyl group. The alkyl group may one or more of the substituents.

An example of the alkenyl group includes a vinylmethyl group.

Examples of the aralkyl group include a benzyl group and a phenethyl group. $m_{11}$ represents 2 or 3.

$R_{13}$ represents a hydrogen atom; and $R_{14}$ represents a hydrogen atom, a lower alkyl group (preferably having from 1 to 4 carbon atoms) or an aralkyl group, or it may be bonded to $R_{12}$ to form a 5-membered or 6-membered ring. Where $R_{14}$ is a hydrogen atom, $R_{13}$ may be bonded to the other $R_{13}$ to form a hydrocarbon or hetero ring, which is preferably 5-membered or 6-membered. $j_{11}$ and $k_{11}$ each represents 0 or 1; $X^{\ominus}$ represents an acid anion; and $n_{11}$ represents 0 or 1.

(II)

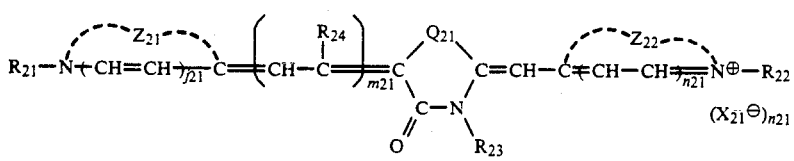

where $Z_{21}$ and $Z_{22}$ have the same meanings as the aforesaid $Z_{11}$ and $Z_{12}$, respectively:

$R_2$ and $R_{22}$ have the same meanings as the aforesaid $R_{11}$ and $R_{12}$, respectively; $R_{23}$ represents an alkyl group, an alkenyl group, an alkynyl group or an aryl group (for example, a substituted or unsubstituted phenyl group);

$m_{21}$ represents 2 or 3; $R_{24}$ represents a hydrogen atom, a lower alkyl group (preferably having from 1 to 4 carbon atoms) or an aryl group; or when $m_{21}$ is 2, the two $R_{24}$'s may be bonded to each other to form a hydrocarbon or hetero ring, which is preferably 5-membered or 6-membered;

$Q_{21}$ represents a sulfur atom, an oxygen atom, a selenium atom or $>N—R_{25}$;

$R_{25}$ has the same meaning as $R_{23}$;

$j_{21}$, $R_{21}$, $X_{21}\ominus$ and $n_{21}$ have the same meanings as $j_{11}$, $k_{11}$, $X_{11}\ominus$ and $n_{11}$, respectively.

(III)

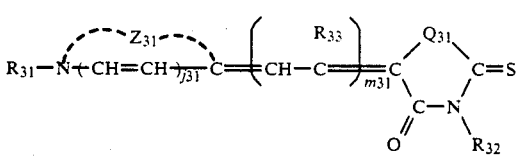

where $Z_{31}$ represents an atomic group necessary for forming a hetero ring. To the ring, the same as those mentioned for $Z_{11}$ and $Z_{12}$ may apply. Examples of the ring include further thiazolidine, thiazoline, benzothiazoline, naphthothiazoline, selenazolidine, selenazoline, benzoselenazoline, naphthoselenazoline, benzoxazoline, naphthoxazoline, dihydropyridine, dihydroquinoline, benzimidazoline and naphthoimidazoline nuclei. $Q_{31}$ has the same meaning as $Q_{21}$. $R_{31}$ has the same meaning as $R_{11}$ Or $R_{12}$. $R_{32}$ has the same meaning as $R_{23}$. $m_{31}$ represents 2 or 3. $R_{33}$ has the same meaning as $R_{24}$; and additionally, $R_{33}$ may be bonded to the other $R_{33}$ to form a hydrocarbon or hetero ring. $j_{31}$ has the same meaning as $j_{11}$.

Of the sensitizing dyes of the formula (I), those wherein heterocyclic nucleus formed by $Z_{11}$ and/or $Z_{12}$ each containing a naphthothiazole nucleus, a naphthoselenazole nucleus, naphthoxazole nucleus, a naphthoindazole nucleus or 4-quinoline nucleus are preferred.

The same shall apply to $Z_{21}$ and/or $Z_{22}$ in the formula (II) and to the formula (III). Such sensitizing dyes where the methine chain forms a hydrocarbon or hetero ring are also preferred.

For infrared-sensitization, M-band sensitization by the sensitizing dye is utilized, and therefore, the spectral sensitivity distribution is generally broader than J-band sensitization. Accordingly, it is preferred to provide a dye-containing colored colloid layer in the position facing to the light-sensitive surface of the determined light-sensitive layer so as to correct the spectral sensitivity distribution.

As the red-sensitizing to infrared-sensitizing dyes, compounds having a reduction potential of −1.00 (volt to SCE) or those which are more anodic than the same are especially preferred. Above all, compounds having a reduction potential of −1 10 or those which are more anodic than the same are particularly preferred. The sensitizing dyes having such characteristic are advantageous for elevating the sensitivity, especially for stabilizing the sensitivity and stabilizing the latent image formed.

Measurement of reduction potential can be effected by phase differentiation type secondary higher harmonics alternating current polarography, where a dropping mercury electrode is employed as the working electrode, a saturated calomel electrode (SCE) as the reference electrode, and platinum as the counter electrode.

Measurement of reduction potential by phase differentiation type secondary higher harmonics alternating current voltammetry where platinum is employed as the working electrode is described in *Journal of Imaging Science,* Vol. 30, pages 27 to 35 (1986).

Specific examples of sensitizing dyes of formula (I), (II) and (III) are mentioned below.

(I-1)

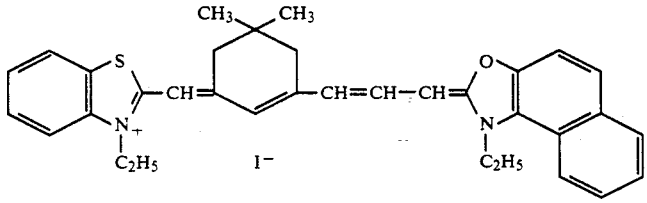

-continued
(I-2)
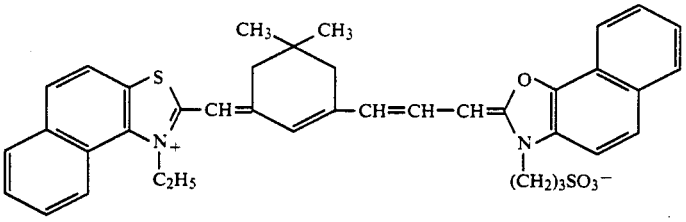
(I-3)
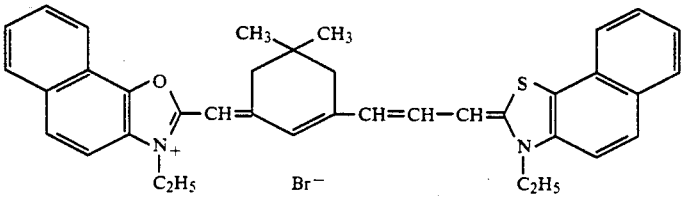
(I-4)
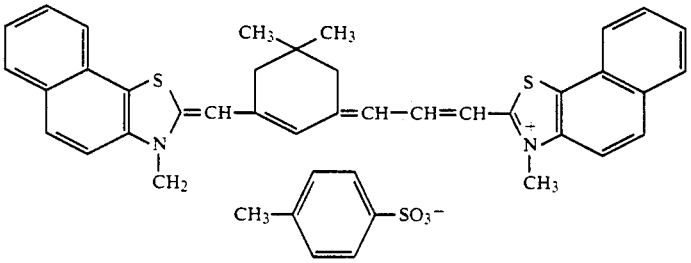
(I-5)
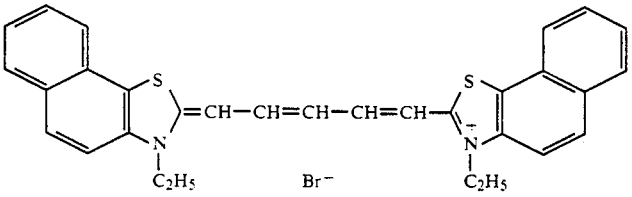
(I-6)
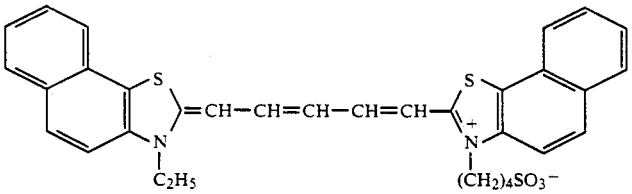
(I-7)
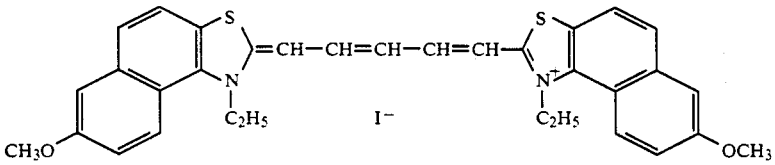
(I-8)
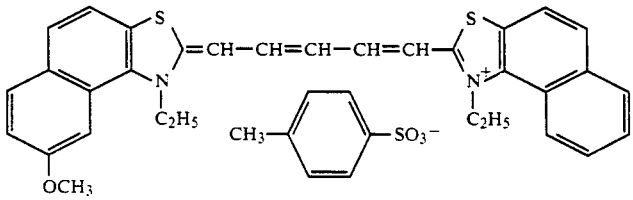

-continued
(I-9)
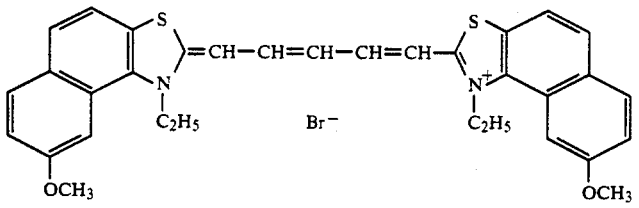
(I-10)
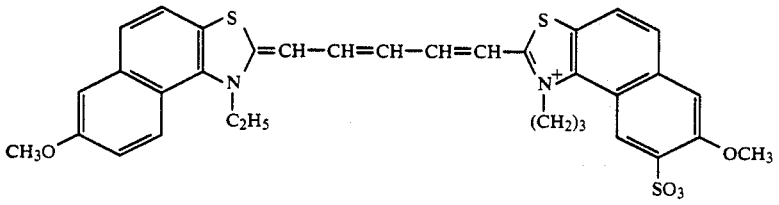
(I-11)
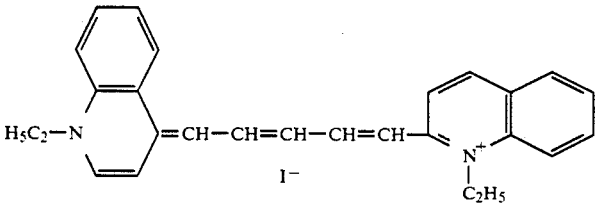
(I-12)
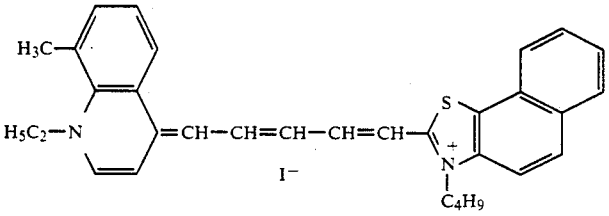
(I-13)
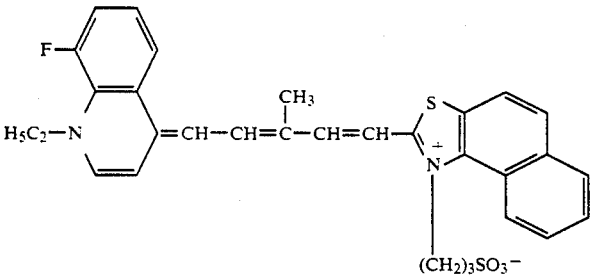
(I-14)
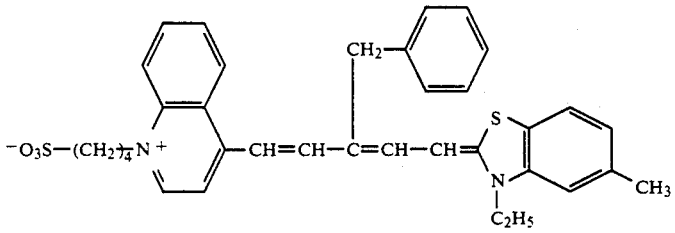
(I-15)
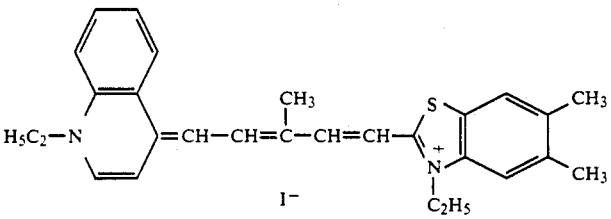

-continued
(I-16)
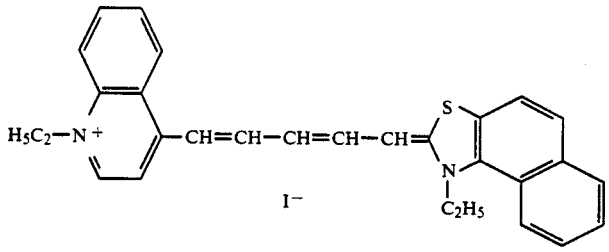
(I-17)
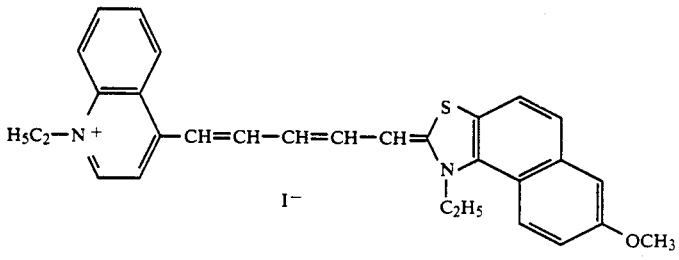
(II-1)
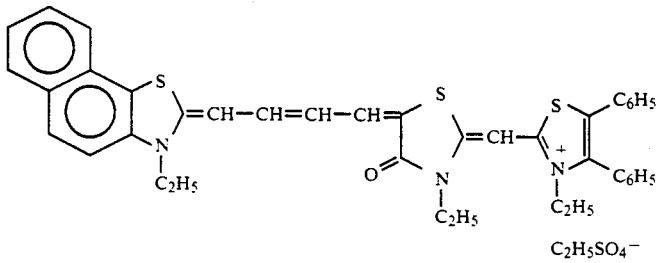
(II-2)
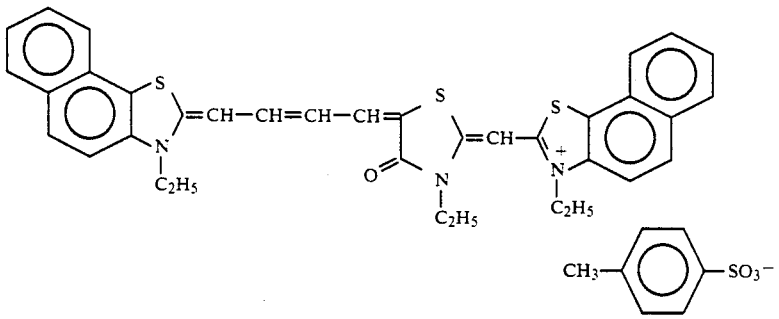
(II-3)
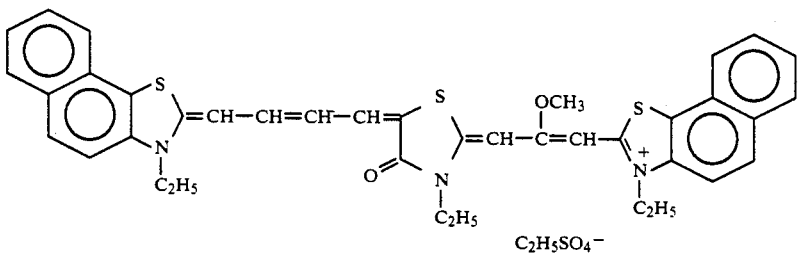
(II-4)
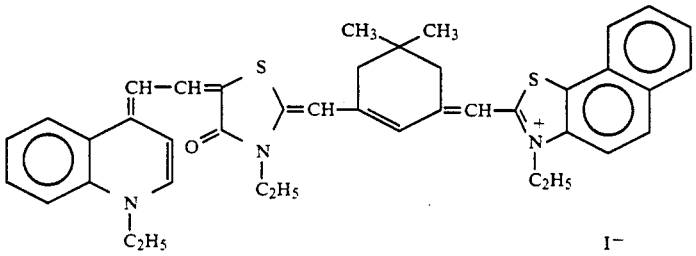

-continued (II-5)

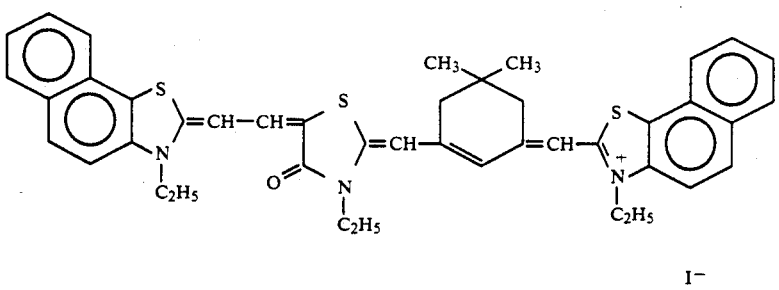

(II-6)

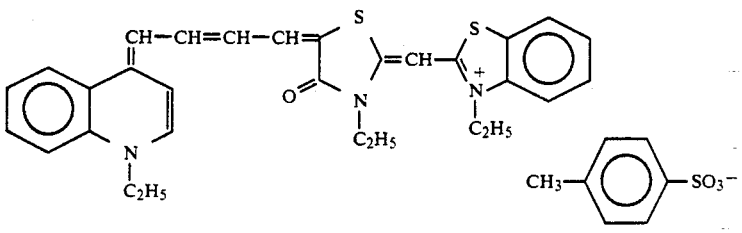

(III-1)

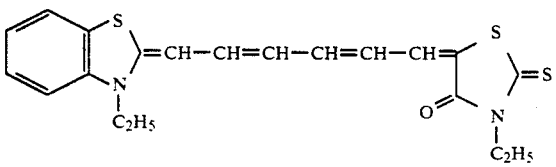

(III-2)

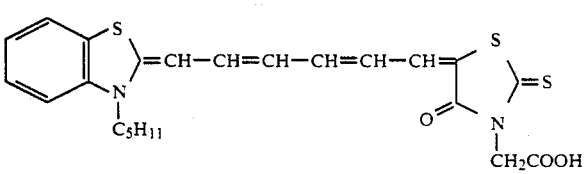

(III-3)

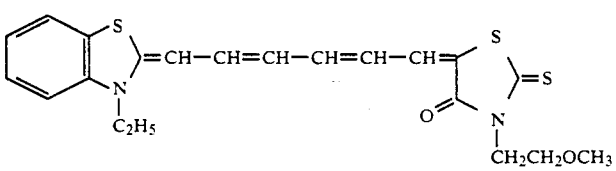

(III-4)

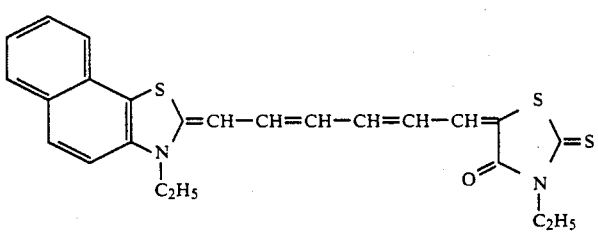

In accordance with the present invention, the sensitizing dye is incorporated into the silver halide photographic emulsion in an amount of from $5\times10^{-7}$ mol to $5\times10^{-3}$ mol, preferably from $1\times10^{-6}$ mol to $1\times10^{-3}$ mol, more preferably from $2\times10^{-6}$ mol to $5\times10^{-4}$ mol, per mol of the silver halide.

The sensitizing dye may directly be dispersed in the emulsion. Alternatively, it may first be dissolved in a pertinent solvent such as methyl alcohol, ethyl alcohol, methyl cellosolve, acetone, water or pyridine or a mixed solvent thereof and then the resulting solution may be added to the emulsion. For such dissolution, ultrasonic waves may be employed. For adding the infrared sensitizing dye to the emulsion, various known methods may be employed. For instance, there are mentioned a method of dissolving the dye in a volatile organic solvent, dispersing the resulting solution in a hydrophilic colloid and then adding the resulting dispersion into the emulsion, described in U.S. Pat. No. 3,469,987; a method of dispersing the water-insoluble dye in a water-soluble solvent without dissolving the dye and then adding the resulting dispersion into the emulsion, described in JP-B-46-24185; a method of dissolving the dye in a surfactant and then adding the resulting solution to the emulsion, described in U.S. Pat.

No. 3,822,135; a method of dissolving the dye in a compound having a red-shifting function and then adding the resulting solution to the emulsion, described in JP-A-51-74624; and a method of dissolving the dye in a substantially water-free acid and then adding the resulting solution to the emulsion, described in JP-A-50-80826. In addition, the methods described in U.S. Pat. Nos. 2,912,343, 3,342,605, 2,996,287 and 3,429,835 can also be employed for adding the sensitizing dyes to the emulsion. The above mentioned infrared-sensitizing dye may uniformly dispersed in the silver halide emulsion before coating the emulsion on a pertinent support. Further, it may be also be added to the emulsion before chemical sensitization or in a latter half stage of the step of forming the silver halide grains.

A dye which does not have a spectral sensitizing activity by itself, or a substance which does not substantially absorb visible rays but which has a supercolor sensitizing activity, can be incorporated into the emulsion of the present invention together with the above-noted sensitizing dyes. For example, aminostylbene compounds (for example, those described in U.S. Pat. Nos. 2,933,390, 3,635,721, 3,615,613, 3,615,641, 3,617,295, 3,635,721, JP-A-61-306030) or aromatic or heterocyclic mercapto compounds are preferably incorporated into the emulsion, especially into high silver chloride emulsions, as a supersensitizing agents.

To the high silver chloride emulsion for use in the present invention, at least one thiosulfonyl group-containing compound of anyone of the following formulae (IV) to (VI) is preferably added, whereby the increase of fog, especially when a gold sensitizing agent is used, is effectively prevented. The thiosulfonyl group-containing compound may be added at any stage of grain-formation, desalting, chemical ripening, or just before the coating step. Above all, it is preferred to add the compound in the stage of grain formation, desalting, chemical ripening, and especially before the addition of a gold sensitizing agent.

Thiosulfonyl group-containing compounds for use in the present invention are represented by anyone of the following formulae (IV), (V) and (VI):

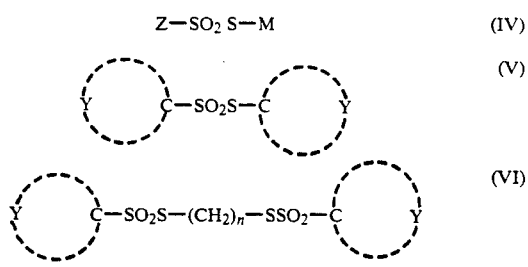

In these formulae, Z represents an alkyl group, an aryl group or a heterocyclic group, which may further be substituted. Y represents an atomic group necessary for forming an aromatic ring or a hetero ring, which may further be substituted. M represents a metal atom or an organic cation. n represents an integer of from 2 to 10.

Examples of the substituents for the above-mentioned alkyl group, aryl group, aromatic ring or hetero ring include a .lower alkyl group such as methyl or ethyl group, an aryl group such as phenyl, an alkoxy group having from 1 to 8 carbon atoms, a halogen atom such as chlorine, a nitro group, an amino group and a carboxyl group.

The alkyl group represented by z has from 1 to 18 carbon atoms; and the aryl group or aromatic ring represented by Z and Y has from 6 to 18 carbon atoms.

Preferably the hetero ring represented by Z and Y are 5- to 7-membered ring containing at least one of N, O and S atoms as a hetero atom and the hetero rings further are condensed with an aromatic ring. Examples of the rings include thiazole, benzothiazole, imidazole, benzimidazole, tetrazole and oxazole rings.

As the metal cation represented by M, an alkali metal cation such as sodium or potassium ion is preferred; and as the organic cation represented by M, ammonium ion or guanidium ion is preferred.

Specific non-limiting examples of the compounds of the formula (IV), (V) or (VI) are mentioned below.

a

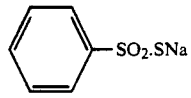

b

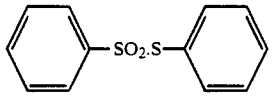

c

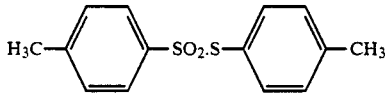

d

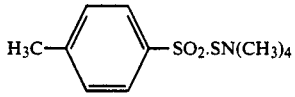

$H_3C.SO_2.SNa$ e f

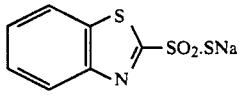

g

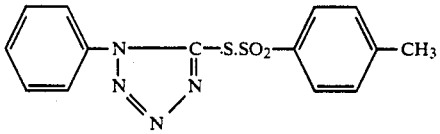

h

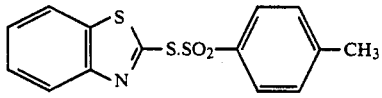

i

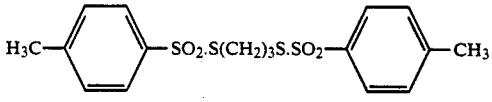

j

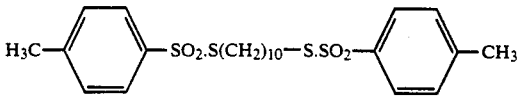

L-cystine-disulfoxide k $H_5C_2—SO_2—S.K$ l

-continued $H_{17}C_8.SO_2—SNa$ m

The compounds represented by formula (IV), (V) or (VI) are disclosed in JP-A-63-304253.

The amount of the compound to be incorporated to the silver halide is preferably not more than $10^{-2}$ mol, more preferably from $10^{-8}$ to $3\times10^{-3}$, and most preferably from $10^{-7}$ to $10^{-3}$ mol per mol of the silver halide.

In accordance with the method of the present invention, compound of the formulae (IV), (V) or (VI) can be used together with a sulfite or a sulfinate such as an alkylsulfinate, an arylsulfinate or a heterocyclic-sulfinate.

The photographic emulsion for use in the present invention can contain various compounds to prevent fog formation during the manufacture, storage or photographic processing step of the photographic material, or to stabilize the photographic properties of the material. These compounds, known as antifoggants or stabilizers, include, for example, azoles such as benzo thiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (especially, 1-phenyl-5-mercaptotetrazole), mercaptopyrimidines and mercaptotriazines; thioketo compounds such as oxazolinethione; azaindenes such as triazaindenes, tetraazaindenes (especially, 4-hydroxysubstituted (1,3,3a,7)tetraazaindene), pentaazaindenes; as well as benzenethiosulfonic acids, benzenesulfinic acids and benzenesulfonic acid amides.

Color photographic materials generally contain yellow couplers, magenta couplers and cyan couplers, which couple with the oxidation product of an aromatic amine developing agent to provide yellow, magenta and cyan colors, respectively.

As yellow couplers for use in the present invention, acylacetamide derivatives such as benzoylacetanilides or pivaloylacetanilides are preferred.

Above all, yellow couplers represented by the following formula (Y-1) or (Y-2) are particularly preferred for use in the present invention.

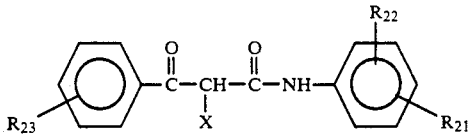

(Y-1)

-continued

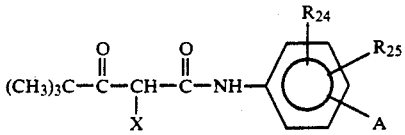

(Y-2)

In the the formulae, X represents a hydrogen atom or a coupling-releasing group. $R_{21}$ represents a non-diffusing group having a total of from 8 to 32 carbon atoms, and $R_{22}$ represents hydrogen or one or more (preferably from 1 to 4) halogen atoms, lower alkyl groups preferably having from 1 to 4 carbon atoms, lower alkoxy groups preferably having from 1 to 4 carbon atoms and/or non-diffusing groups having a total of from 8 to 32 carbon atoms. $R_{23}$ represents hydrogen or a substituent. When the formula has two or more $R_{23}$ groups, the $R_{23}$ groups may be same or different. $R_{24}$ represents a halogen atom, an alkoxy group, a trifluoromethyl group, or an aryl group. $R_{25}$ represents a hydrogen atom, a halogen atom or an alkoxy group. A represents $—NHCOR_{26}$, $$—NHSO_2R_{26},\quad —SO_2NHR_{26},\quad —COOR_{26},\quad —SO_2\underset{\underset{R_{27}}{|}}{N}—R_{26},$$

wherein $R_{26}$ and $R_{27}$ each represents an alkyl group, an aryl group or an acyl group.

Pivaloylacetanilide yellow couplers for use in the present invention are described in U.S. Pat. No. 4,622,287, from column 3, line 15 to column 8, line 39, and in U.S. Pat. No. 4,623,616, from column 14, line 50 to column 19, line 41.

Benzoylacetanilide yellow couplers for use in the present invention are described in U.S. Pat. Nos. 3,408,194, 3,933,501, 4,046,575, 4,133,958 and 4,401,752.

Preferred examples of pivaloylacetanilide yellow couplers for use in the present invention include the compounds (Y-1) to (Y-39) described in the aforesaid U.S. Pat. No. 4,622,287, columns 37 to 54. Above all, compounds (Y-1), (Y-4), (Y-6),(Y 7), (Y-15, (Y 21), (Y-22), (Y-23), (Y-26), (Y-35), (Y-36), (Y-37), (Y-38) and (Y-39) are particularly preferred.

In addition, the compounds (Y 1) to (Y-33) described in the aforesaid U.S. Pat. No. 4,623,616, columns 19 to 24 are also preferred, and compounds (Y-2), (Y-7), (Y-8), (Y-12), (Y-20), (Y-21), (Y-23) and (Y-29) are particularly preferred.

Other preferred compounds include compound (34) described in U.S. Pat. No. 3,408,194, column 6; compounds (16) and (19) described in U.S. Pat. No. 3,933,501; compound (9) described in U.S. Pat. No. 4,046,575, columns 7 and 8; compound (1) described in U.S. Pat. No. 4,133,958, columns 5 and 6; compound (1) described in U.S. Pat. No. 4,401,752, column 5; and the following compounds (a) to (h).

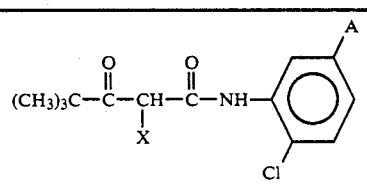

| Compound | A | X |
|---|---|---|

-continued
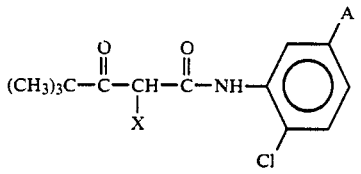
| | | |
|---|---|---|
| a | $-COOCH(CH_3)COOC_{12}H_{25}$ | 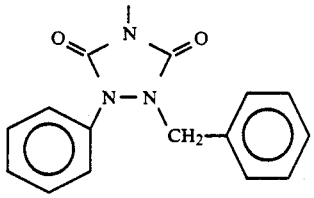 |
| b | $-COOCH(C_4H_9)COOC_{12}H_{25}$ | " |
| c | 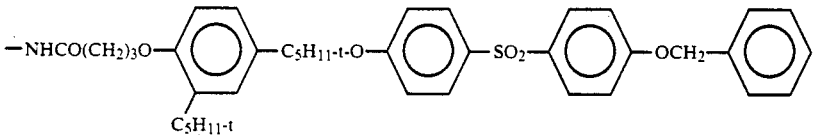 | |
| d | 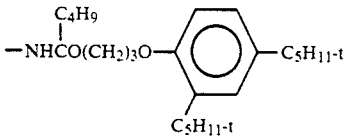 | 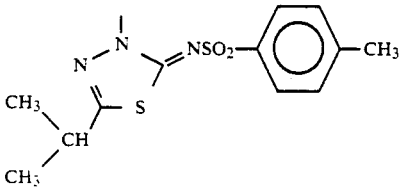 |
| Compound | $R_{22.4}$ | X |
|---|---|---|
| e | 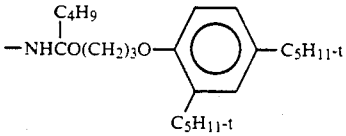 | 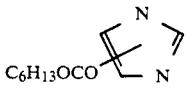 |
| f | $-NHSO_2C_{12}H_{25}$ | 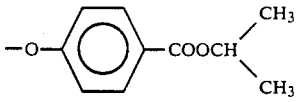 |
| g | $-NHSO_2C_{16}H_{33}$ | 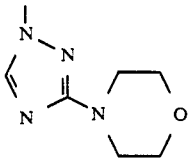 |
| h | 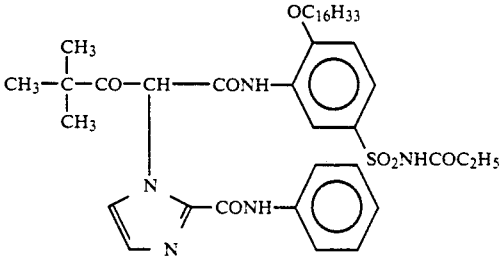 | |

-continued

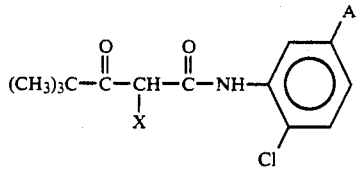

Among the above-mentioned couplers, those having a nitrogen atom as a releasing atom are particularly preferred.

Magenta couplers for use in the present invention include oil-protected indazolone or cyanoacetyl compounds, preferably 5-pyrazolone or pyrazoloazole couplers such as pyrazolotriazoles. As 5-pyrazolone couplers, those having an arylamino or acylamino group in the 3-position are preferred from the viewpoint of the hue and density of the colors formed therefrom. Specific examples of such couplers are described in U.S. Pat. Nos. 2,311,082, 2,343,703, 2,600,788, 2,908,573, 3,062,653, 3,152,896 and 3,936,015.

As the releasing group in 2-equivalent pyrazolone couplers, the nitrogen atom-releasing groups described in U.S. Pat. No. 4,310,619 as well as the arylthio groups described in U.S. Pat. No. 4,351,897 are preferred. Ballast group-containing 5-pyrazolone couplers as described in European Patent No. 73,636 are preferred as providing colors having a high density.

Pyrazoloazole couplers for use in the present invention include pyrazolobenzimidazoles as described in U.S. Pat. No. 3,369,879, and preferably pyrazolo[5,1-c]-[1,2,4]triazoles as described in U.S. Pat. No. 3,725,067, pyrazolotetrazoles as described in *Research Disclosure* (Item 24220, June, 1984) and pyrazolopyrazoles as described in *Research Disclosure* (Item 24230, June, 1984). The above-mentioned couplers may be in the form of a polymer coupler.

The above-noted couplers can be represented by the following general formula (M-1), (M-2) or (M-3):

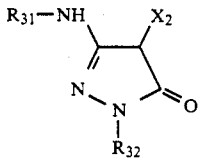

(M-1)

-continued

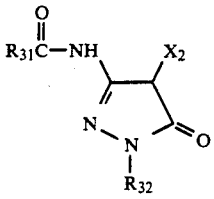

(M-2)

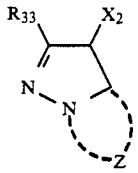

(M-3)

In these formulae, $R_{31}$ represents a nondiffusing group having a total of from 8 to 32 carbon atoms, and $R_{32}$ represents a phenyl group or a substituted phenyl group. $R_{33}$ represents a hydrogen atom or a substitutent. Z represents a non-metallic atomic group necessary for forming a 5-membered azole ring containing from 2 to 4 nitrogen atoms, and the azole ring may be substituted or condensed with other rings.

$X_2$ represents a hydrogen atom or a releasing group. Substituents for $R_{33}$ or the substituents for the azole ring are described, for example, in U.S. Pat. No. 4,540,654, from column 2, line 41 to column 8, line 27.

Among the pyrazoloazole couplers, imidazo[1,2-b]pyrazoles as described in U.S. Pat. No. 4,500,630 are preferred as providing dyes having a small yellow side absorption and high light-fastness, and the pyrazolo-1,5-b][1,2,4]triazoles as described in U.S. Pat. No. 4,540,654 are particularly preferred.

In addition, pyrazolotriazole couplers having a branched alkyl group directly bonded to the 2-, 3- or 6-position of the pyrazolotriazole ring, as described in JP-A-61-65245; pyrazoloazole couplers having a sulfonamido group, as described in JP A-61-65246; pyrazoloazole couplers having an alkoxyphenylsulfonamido ballast group, as described in JP-A-61-147254; as well as pyrazolotriazole couplers having an alkoxy or aryloxy group at the 6-position, as described in European Patent Laid-Open No. 226,849 are preferably used in the present invention.

Specific, non-limiting examples of these couplers are given below.

| Compound | $R_{33}$ | $R_{34}$ | $X_2$ |
|---|---|---|---|
| | | 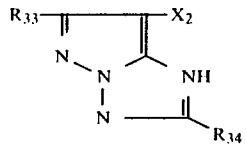 | |
| M-1 | $CH_3$— | 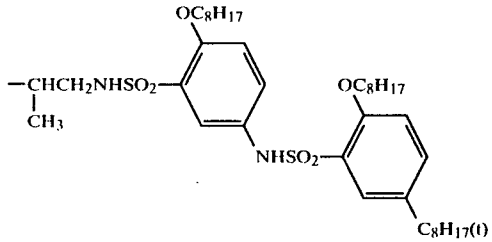 | Cl |
| M-2 | " | 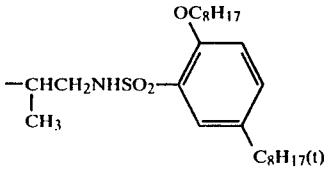 | " |
| M-3 | " | 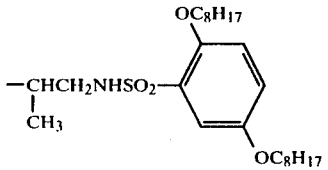 | 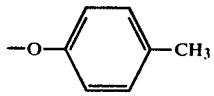 |
| M-4 | 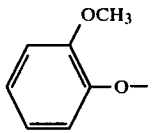 | 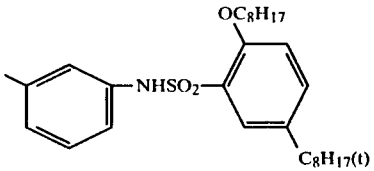 | 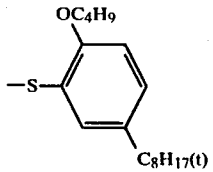 |

-continued
| Compound | $R_{33}$ | $R_{34}$ | $X_2$ |
|---|---|---|---|
| M-5 | $CH_3$— | 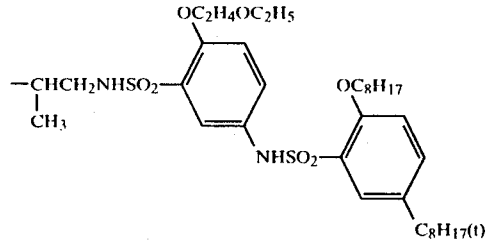 | Cl |
| M-6 | $CH_3$— | 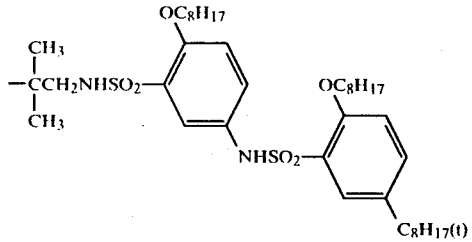 | Cl |
| M-7 | 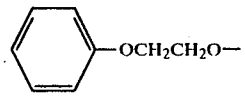 | 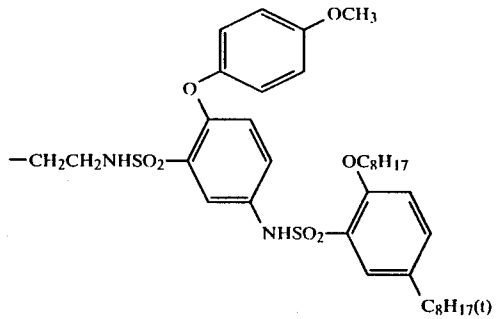 | 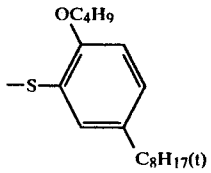 |
| M-8 | $CH_3CH_2O$— | " | " |
| M-9 | 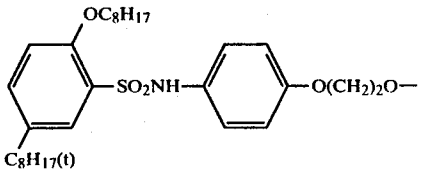 | 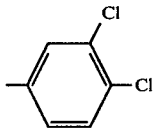 | 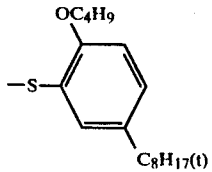 |

-continued
| Compound | $R_{33}$ | $R_{34}$ | $X_2$ |
|---|---|---|---|
| M-10 | 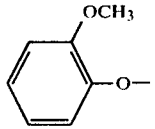 | 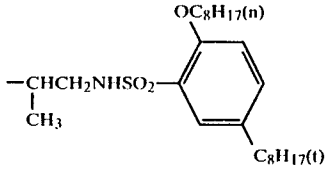 | Cl |
| | 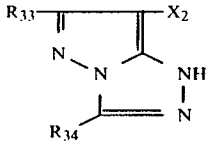 | | |
| M-11 | $CH_3$— | 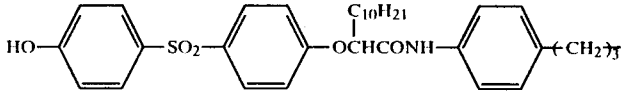 | Cl |
| M-12 | " | 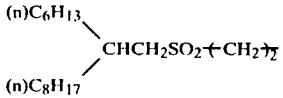 | " |
| M-13 | 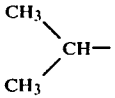 | 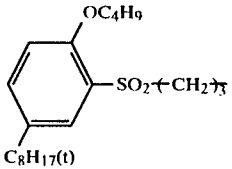 | " |
| M-14 | 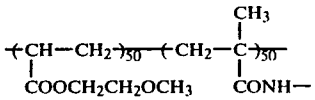 (the proportion of monomers is shown by weight ratio) | 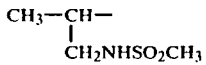 | " |

-continued
| Compound | $R_{33}$ | $R_{34}$ | $X_2$ |
|---|---|---|---|
| M-15 | 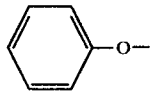 | 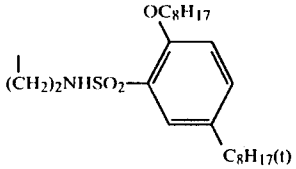 | Cl |
| M-16 | 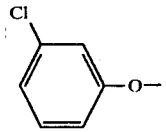 | 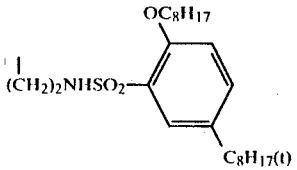 | 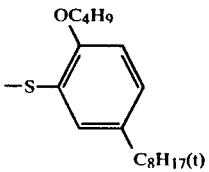 |
| (M-17) | | 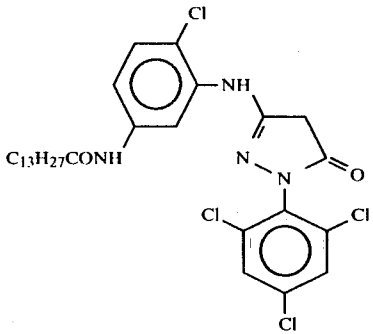 | |
| (M-18) | | 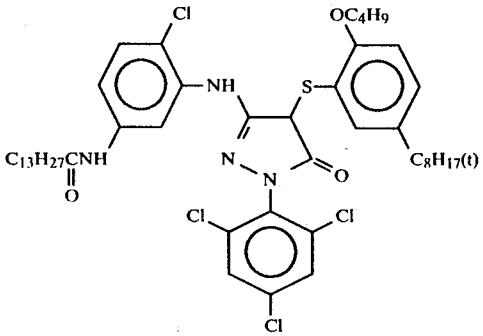 | |

-continued
| Compound | $R_{33}$ | $R_{34}$ | $X_2$ |
|---|---|---|---|
| (M-19) | | 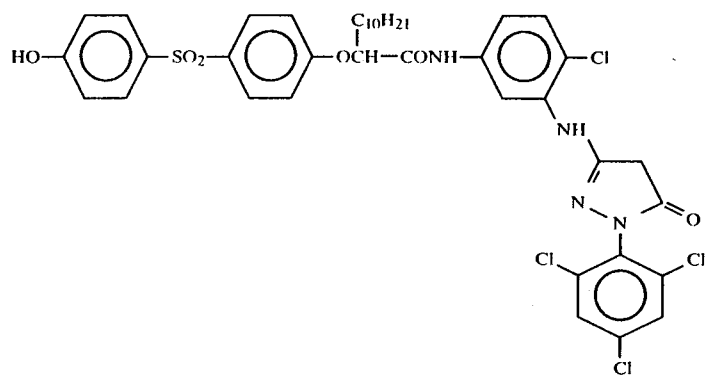 | |
| (M-20) | | 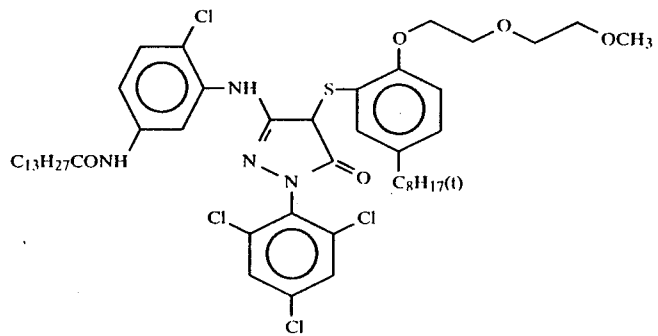 | |
| (M-21) | | 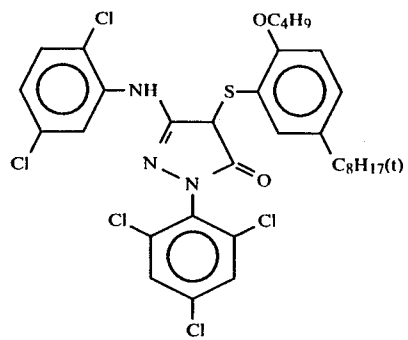 | |

-continued

| Compound | $R_{33}$ | $R_{34}$ | $X_2$ |
|---|---|---|---|
| (M-22) | | | |
| (M-23) | | | |
| (M-24) | | | |

-continued
| Compound | $R_{33}$ | $R_{34}$ | $X_2$ |
|---|---|---|---|
| (M-25) | | 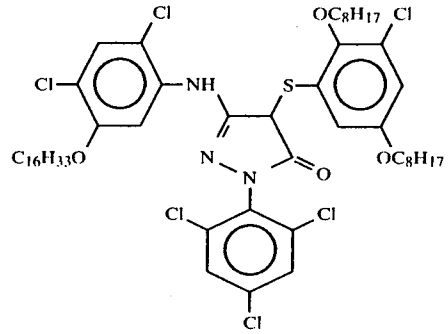 | |
| (M-26) | | 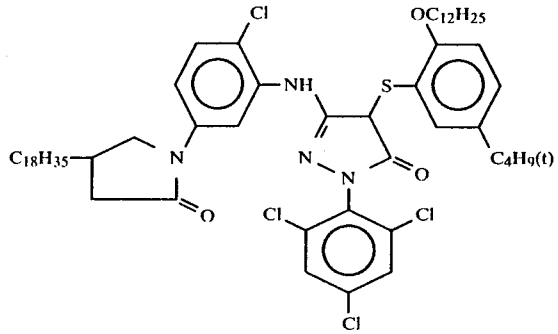 | |
| (M-27) | | 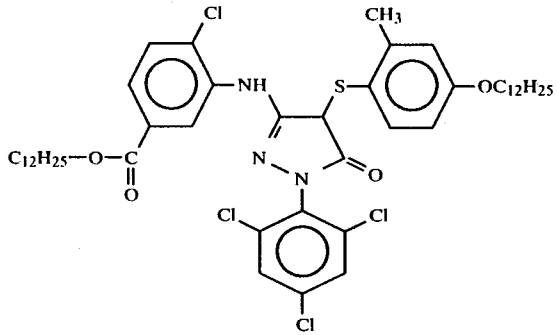 | |

-continued
| Compound | $R_{33}$ | $R_{34}$ | $X_2$ |
|---|---|---|---|
| (M-28) | | 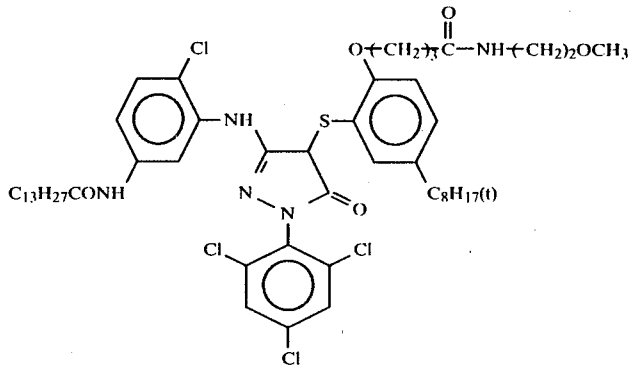 | |
| (M-29) | | 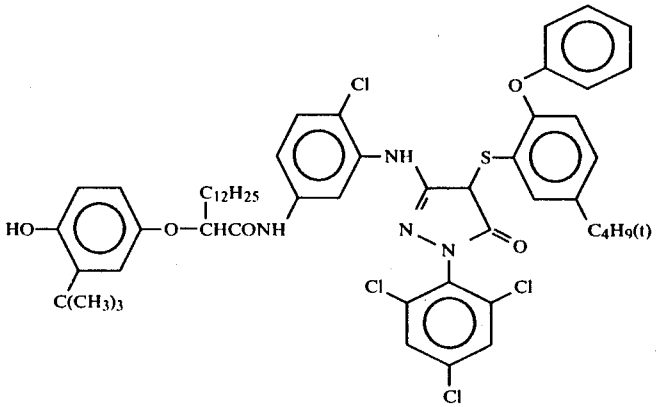 | |

-continued
| Compound | $R_{33}$ | $R_{34}$ | $X_2$ |
|---|---|---|---|
| (M-30) | | 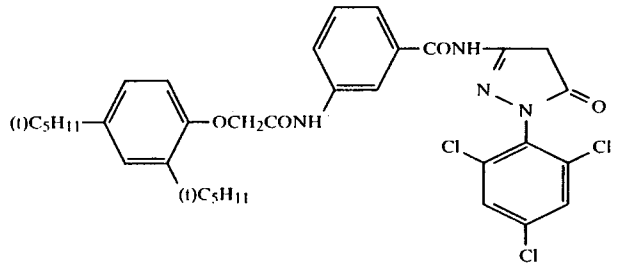 | |
| (M-31) | | 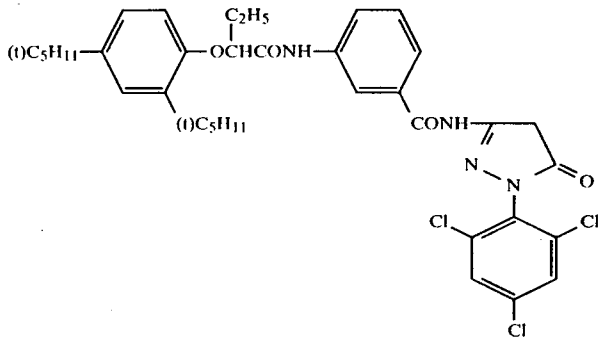 | |
| (M-32) | | 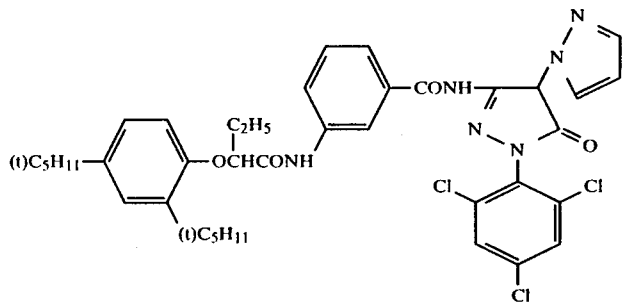 | |

Cyan couplers for use in the present invention include phenol cyan couplers and naphthol cyan couplers.

Phenol cyan couplers for use in the present invention include those having an acylamino group at the 2-position and an alkyl group at the 5-position of the phenol nucleus (including polymer couplers), as described, for example, in U.S. Pat. Nos. 2,369,929, 4,518,687, 4,511,647 and 3,772,002. Examples of such compounds include the coupler of Example 2 in Canadian Patent 625,822, the compound (1) described in U.S. Pat. No. 3,772,002, the compounds (I-4) and (I-5) described in U.S. Pat. No. 4,564,590, the compounds (1), (2), (3) and (24) described in JP-A-61-39045 and the compound (C-2) described in JP-A-62-70846.

Phenol cyan couplers for use in the present invention further include the 2,5-diacylaminophenol couplers described in U.S. Pat. Nos. 2,772,162, 2,895,826, 4,334,011 and 4,500,653 and JP-A-59-164555. Specific examples of such compounds include the compound (V) described in U.S. Pat. No. 2,895,826, the compound (17) described in U.S. Pat. No. 4,557,999, the compounds (2) and (12) described in U.S. Pat. No. 4,565,777, the compound (4) described in U.S. Pat. No. 4,124,396 and the compound (I-19) described in U.S. Pat. No. 4,613,564.

Phenol cyan couplers for use in the present invention further include the nitrogen-containing heterocyclic ring-condensed phenol couplers described in U.S. Pat. Nos. 4,327,173, 4,564,586 and 4,430,423, JP A-61-390441 and JP-A-62-257158. Specific examples of such couplers include the couplers (1) and (3) described in U.S. Pat. No. 4,327,173, the compounds (3) and (16) described in U.S. Pat. No. 4,564,586, the compounds (1) and (3) described in U.S. Pat. No. 4,430,423 and the following compounds.

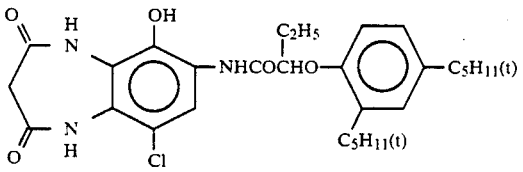

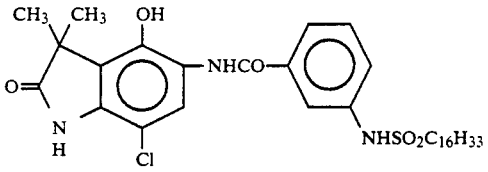

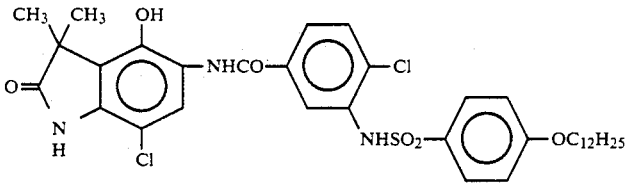

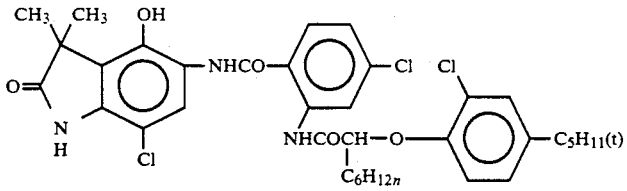

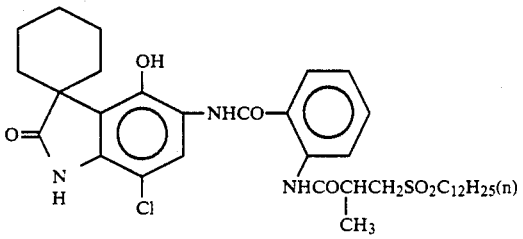

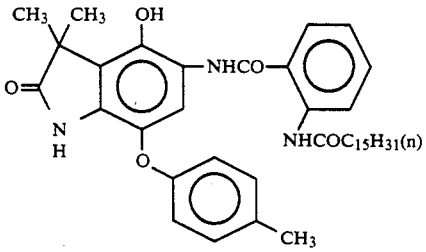

-continued

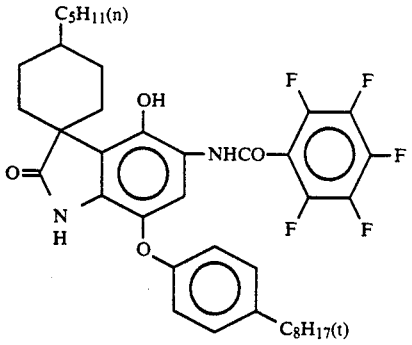

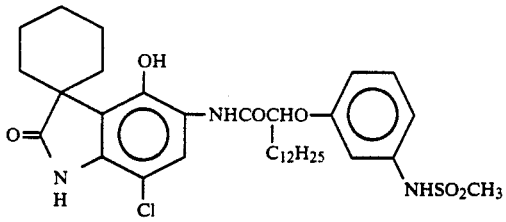

Phenol cyan couplers for use in the present invention further include the ureido couplers described in U.S. Pat. No. 4,333,999, 4,451,559, 4,444,872, 4,427,767 and 4,579,813 and European Patent (EP) 067,689 Bl. Specific examples of such couplers include the coupler (7) described in U.S. Pat. No. 4,333,999, the coupler (1) described in U.S. Pat. No. 4,451,559, the coupler (14) described in U.S. Pat. No. 4,444,872, the coupler (3) described in U.S. Pat. No. 4,427,767, the couplers (6) and (24) described in U.S. Patent 4,609,619, the couplers (1) and (11) described in U.S. Pat. No. 4,579,813, the couplers (45) and (50) described in European Patent 067,689 Bl, and the coupler (3) described in JP-A-61-42658.

Naphthol cyan couplers for use in the present invention include naphthol compounds having an N alkyl-N-arylcarbamoyl group at the 2-position of the naphthol nucleus as described, for example, in U.S. Pat. No. 2,313,586; naphthol compounds having an alkylcarbamoyl group at the 2-position as described, for example, in U.S. Pat. Nos. 2,474,293 and 4,282,312); naphthol compounds having an arylcarbamoyl group at the 2-position as described, for example, in JP-B-50-14523; naphthol compounds having a carbonamido or sulfonamido group at the 5-position as described, for example, in JP-A-60-237448, JP-A-61-145557, JP-A-61-153640; naphthol compounds having an aryloxy-releasing group as described, for example, in U.S. Pat. No. 3,476,563; naphthol compounds having a substituted alkoxy-releasing group as described, for example, in U.S. Pat. No. 4,296,199; and naphthol compounds having a glycolic acid-releasing group as described, for example, in JP-B-60-39217.

The couplers for use in the present invention are oil-soluble. Accordingly, the coupler is preferably dissolved in a high boiling point organic solvent, and optionally together with a low boiling point organic solvent. The resulting solution is emulsified and dispersed in an aqueous gelatin solution, and the resulting dispersion is added to a silver halide emulsion. Any known additives, such as hydroquinone derivatives, ultraviolet absorbent or anti-fading agents, can be added to the emulsion without impairing the effect of the present invention. The method of adding the coupler to the emulsion is described in detail. The coupler is first dissolved in anyone of high boiling point organic solvents of the following general formulae (VIII) to (XIII), and optionally in combination with a low boiling point organic solvent, such as ethyl acetate, butyl acetate, butyl propionate, cyclohexanol, cyclohexane or tetrahydrofuran, and optionally together with a hydroquinone derivative, ultraviolet absorbent or anti-fading agent. The high boiling point organic solvent and the low boiling point organic solvent can be used alone or as a mixture thereof. The resulting solution is then mixed with an aqueous solution containing a hydrophilic binder such as gelatin, which contains an anionic surfactant (e.g., alkylbenzenesulfonic acids, alkylnaphthalenesulfonic acids) and/or a nonionic surfactant (e.g., sorbitan sesquioleic acid esters, sorbitan monolauric acid esters), and the resulting mixture is emulsified and dispersed in a high speed rotary mixer, colloid mill or ultrasonic dispersing apparatus. The thus formed dispersion is added to the silver halide emulsion of the present invention.

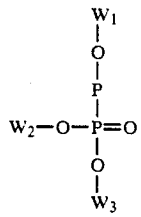

(VIII)

$W_1—COOW_2$ (IX)

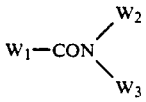

(X)

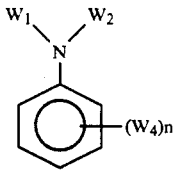

(XI)

$W_1—O—W_2$ (XII)

$HO—W_6$ (XIII)

In the above formulae, $W_1$, $W_2$ and $W_3$ each represents a substituted or unsubstituted alkyl, cycloalkyl, alkenyl, aryl or heterocyclic group; $W_4$ is the group $W_1$, O-$W_1$ or S-$W_1$; n represents an integer of from 1 to 5, and when n is 2 or more, plural $W_4$ groups may be same or different. In the formula (XIII), $W_1$ and $W_2$ may be bonded to each other to form a condensed ring.

$W_6$ represents a Substituted or unsubstituted alkyl or aryl group, and the total number of carbon atoms for constituting $W_6$ is 12 or more.

Solvents other than those of the above mentioned formulae (VIII) to (XIII) may also be used as the high boiling point coupler solvent in the present invention, provided that they are good solvents for the couplers, are non-miscible with water, and have a melting point of 100° C. or lower and a boiling point of 140° C. or higher. The melting point of the high boiling point coupler solvents is preferably 80° C. or lower. The boiling point of the high boiling point coupler solvents is preferably 160° C. or higher, and more preferably 170° C. or higher.

Coupler solvents having a melting point higher than about 100° C. are unfavorable, as causing crystallization of the couplers, and their use would impair the coloration-improving effect.

The photographic material of the present invention can contain hydroquinone derivatives, aminophenol derivatives, amines, gallic acid derivatives, catechol derivatives, ascorbic acid derivatives, colorless couplers and sulfonamidophenol derivatives, as color-fogging inhibitors or as color mixing preventing agents.

The photographic material of the present invention can contain various anti-fading agents. Specific examples of useful organic anti-fading agents for a cyan, magenta and/or yellow image include hindered phenols such as hydroquinones, 6-hydroxychromans, 5-hydroxycoumarans, spirochromans, p-alkoxyphenols and bisphenols; gallic acid derivatives, methylenedioxybenzenes, aminophenols and hindered amines; as well as ether or ester derivatives formed by silylating or alkylating the phenolic hydroxyl group of the compounds. In addition, metal complexes such as (bis-salicylaldoximato)nickel complexes and (bis N,N-dialkyldithiocarbamato)nickel complexes can also be used as anti-fading agents.

Specific examples of organic anti fading agents are described in the following patent publications.

Specifically, hydroquinones are described in U.S. Pat. Nos. 2,360,290, 2,418,613, 2,700,453, 2,701,197, 2,728,659, 2,732,300, 2,735,765, 3,982,944, 4,430,425, British Patent 1,363,921, U.S. Pat. Nos. 2,710,801 and 2,816,028; 6-hydroxychromans, 5-hydroxycoumarans and spirochromanes are described in U.S. Pat. Nos. 3,432,300, 3,573,050, 3,574,627, 3,698,909, 3,764,337 and JP-A-52-162225; spiroindanes are described in U.S. Pat. No. 4,360,589; p-alkoxyphenols are described in U.S. Pat. No. 2,735,765, British Patent 2,066,975, JP-A-59-10539 and JP-B-57 19764; hindered phenols are in U.S. Pat. No. 3,700,455, JP-A-52-72225, U.S. Pat. No. 4,228,235 and JP-B-52-6623; gallic acid derivatives, methylenedioxybenzenes and aminophenols are described in U.S. Pat. Nos. 3,457,079, 4,332,886 and JP-B-56-21144; hindered amines are described in U.S. Pat. Nos. 3,336,135, 4,268,593, British Patent 1,326,889, 1,354,313, 1,410,846, JP-B-51-1420, JP-A-58-114036, JP-A-59-53846 and JP-A-59-78344; phenolic hydroxyl-ester or ether derivatives are described in U.S. Pat. Nos. 4,155,765, 4,174,220, 4,254,216, 4,264,720, JP-A-54-145530, JP-A-55-6321, JP-A-58-105147, JP-A-59-10539, JP-B-57-37856, U.S. Pat. No. 4,279,990 and JP-B-53-3263; and metal complexes are described in U.S. Pat. Nos. 4,050,938, 4,241,155 and British Patent 2,027,731(A). The compounds are added to the light-sensitive layer by co-emulsifying with a corresponding coupler generally in an amount of from 5 to 100% by weight of the coupler, as required to provide the anti-fading property. In order to protect cyan color images against heat, especially against light, it is effective to incorporate an ultraviolet absorbent to adjacent layers above and below the cyan coloring layer.

Among the above-noted anti-fading agents, spiroindanes and hindered amines are especially preferred.

The light-sensitive material may contain an ultraviolet absorbent in the hydrophilic colloid layer. For instance, aryl-substituted benzotriazoles (for example, those described in U.S. Pat. No. 3,533,794), 4-thiazolidone compounds (for example, those described in U.S. Pat. Nos. 3,314,794 and 3,352,681), benzophenone compounds (for example, those described in JP-A-46-2784), cinnamic acid ester compounds (for example, those described in U.S. Pat. Nos. 3,705,805 and 3,707,375), butadiene compounds (for example, those described in U.S. Pat. No. 4,045,229) and benzoxidol compounds (for example, those described in U.S. Pat. No. 3,700,455) can be used as ultraviolet absorbents. Further, ultraviolet absorbing couplers (for example α-naphthol cyan dye-forming couplers) as well as ultraviolet absorbing polymers may also be used. The ultraviolet absorbents may be mordanted in a particular layer.

The photographic material of the present invention can contain water-soluble dyes in the hydrophilic colloid layer as a filter dye or for the purpose of anti-irradiation or for other various purposes. Such dyes include oxonole dyes, hemioxonole dyes, styryl dyes, merocyanine dyes, cyanine dyes and azo dyes. Above all, oxonole dyes, hemioxonole dyes and merocyanine dyes are preferred. Useful oxonole dyes are described, for example, in JP-A-62-215272, from page 158, left-upper column to page 163.

Gelatin is advantageously used as the binder or protective colloid in the emulsion layer of the photographic material of the present invention, but any other hydrophilic colloid can also be used alone or together with gelatin.

The gelatin for use in the present invention may be either a lime-processed or an acid-processed gelatin. Methods of preparing gelatin are described, for example, in A. Vais, *The Macromolecular Chemistry of Gelatin* (published by Academic Press, 1964).

The "reflective support" for use in the present invention is a support having an elevated reflectivity so as to sharpen the color image formed on the silver halide emulsion layer thereon. Such reflective supports include a support coated with a hydrophobic resin containing a dispersed light-reflecting substance such as titanium oxide, zinc oxide, calcium carbonate or calcium sulfate as well as a support containing a dispersion of such light reflecting substance therein. Supports for use in the present invention include baryta paper, polyethylene-coated paper, polypropylene-type synthetic paper, as well as reflective layer-coated or reflecting substance-containing transparent supports of, for example, glass plate, polyethylene terephthalate, cellulose triacetate, cellulose nitrate or the like polyester film, or polyamide film, polycarbonate film, polystyrene film or vinyl chloride resin. The support is properly selected in accordance with the use and the object of the photographic material.

The light-reflecting substance is preferably a blend formed by well kneading a white pigment in the presence of a surfactant. In addition, pigment grains surface-treated with a 2- to 4-hydric alcohol are also preferred.

The possessory area ratio (%) of fine white pigment grains per a defined unit area is calculated by dividing the observed area into the adjacent 6 μm ×6 μm unit areas and determining the possessory area ratio (%) ($R_i$) of the fine grains as projected in the said unit area. The variation coefficient of the possessory area ratio (%) is calculated as a ratio of $s/\overline{R}$, where s is the standard deviation of $R_i$ and $\overline{R}$ is the mean value of $R_i$. The number (n) of the objective unit area is preferably 6 or more. Accordingly, the variation coefficient $s/\overline{R}$ is calculated from the following formula:

$$\text{Variation Coefficient} = \sqrt{\frac{\sum_{i=1}^{n} (R_i - R)^2}{n-1}} \Big/ \frac{\sum_{i=1}^{n} R_i}{n}$$

The possessory area ratio of the fine pigment grains to use in the present invention is preferably 0.15 or less, and more preferably 0.12 or less. When the ratio is 0.08 or less, the dispersion degree of the grains is considered to be substantially "uniform".

The light source for scanning exposure for use in the present invention includes a glow lamp, xenone lamp, mercury lamp, tungsten lamp, emission diode, and semiconductor laser such as Ne-He laser, argon laser or He-Cd laser. In addition, a light source comprising a combination of a semiconductor laser and a wavelength-converting element made of a non-linear optical material can also be employed in the present invention. The light source of such combination is small-sized and inexpensive and has a long operating life. Further, the wavelength of the source is relatively short. Accordingly, the light source can advantageously be applied to silver halide photographic materials spectrally sensitized with spectral sensitizing dyes having good raw film storage properties in the visible range.

The wavelength-converting element made of a non-linear optical material, for use in the present invention, is explained below. The "non-linear optical material" means a material which exhibits a non-linear property (non-linear optical effect) between the polarization and the electric field, when a strong photoelectric field such as laser ray is applied thereto. Such materials include, for example, inorganic compounds such as lithium niobate, potassium dihydrogen phosphate (KDP), lithium iodate or $BaB_2O_4$; as well as organic compounds such as urea derivatives, nitroaniline derivatives (e.g., 2-methyl-4-nitroaniline (MNA), 2-N,N-dimethylamino-5-nitroacetanilide (DAN), metanitroaniline, L-N-(4-nitrophenyl)-2-(hydroxymethyl)-pyrrolidine and the compounds described in JP-A-62-210430, JP-A-62-210432 and JP-A-62-187828), nitropyridine-N-oxide derivatives (e.g., 3-methyl-4-nitropyridine-1-oxide (POM)), diacetylene derivatives (e.g., the compounds described in JP-A-56-43220), the compounds described in JP-A-61-60638, JP-A-61-78748, JP-A-61-152647, JP-A-61-137136, JP-A-61-147238, JP-A-61-148433 and JP-A-61-167930, and compounds described in *Nonlinear Optical Properties of Organic and Polymeric Materials*, ACS SYMPOSIUM SERIES 233, (edited by David J. Williams, published by American Chemical Society, 1983), and *Organic Nonlinear Optical Materials* (edited by M. Kato and H. Nakanishi, published by CMC, 1985).

Above all, compounds having a high blue light-transmitting capacity, for example, KDP, lithium iodate, lithium niobate $BaB_2O_4$, urea, POM and compounds described in JP-A-62-210430 and JP-A-62-210432 are preferred for use in the present invention. Especially, POM and the nitroaryl-containing or nitrobenzene-condensed nitrogen-containing heterocyclic compounds described in JP-A-62-210430 and JP-A-62-210432 are particularly preferred.

Of the nitroaryl-substituted nitrogen-containing heterocyclic compounds, those represented by the following general formula (A) are especially preferred.

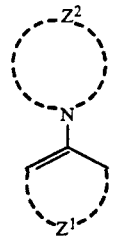

(A)

wherein $Z^1$ represents an atomic group necessary for forming a 5- or 6-membered heterocyclic or aromatic ring having at least one nitro group as a substituent; and $Z^2$ represents an atomic group necessary for forming a pyrrole, imidazole, pyrazole, triazole or tetrazole ring which may optionally be substituted and which may optionally be condensed with other rings.

The details of the 5- or 6-membered aromatic ring and hetero ring of the formula as well as specific examples of the compounds represented by the general formula A are described in JP-A-62-210432. Preferred example of the compounds are shown below:

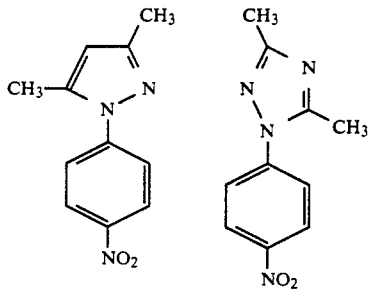

Of the nitrobenzene condensed nitrogen-containing heterocyclic compounds, those represented by the following general formula (B) are particularly preferred. Substituents and specific examples thereof are described in JP-A-62-210432.

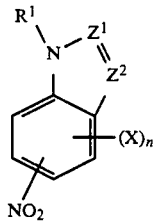

(B)

In the above formula, $Z^1$ and $Z^2$ may be same or different and each represents a nitrogen atom or $CR^2$.

X represents an alkyl group, an aryl group, a halogen atom, an alkoxy group, an aryloxy group, an acylamino group, a carbamoyl group, a sulfamoyl group, an acyloxy group, an alkoxycarbonyl group, an aryloxycarbonyl group, an alkoxysulfonyl group, an aryloxysulfonyl group, an alkylthio group, an arylthio group, a hydroxyl group, a thiol group, a carboxyl group, an ureido group, a cyano group, an alkylsulfonyl group, an arylsulfonyl group, an alkylsulfinyl group, an arylsulfinyl group or a nitro group. n represents 0 or an integer of from 1 to 3. $R^1$ represents hydrogen, an alkyl group, an aryl group or an acyl group; $R^2$ represents hydrogen, an alkyl group or an aryl group. The alkyl group and aryl group in X, $R^1$ and $R^2$ may optionally be substituted.

The non-linear optical effect includes, as secondary effects, generation of secondary higher harmonics, light mixing, parametric oscillation, light rectification and Pockels effect; and as a cubic effects, generation of tertiary higher harmonics, Kerr effect, optical bi-stability, stabilization and light mixing. In addition, the nonlinear optical effect further includes effects of higher order. The great advantage in the use of nonlinear optical materials in that the light of a semiconductor laser of infrared wavelength can be converted into visible light. Accordingly, secondary higher harmonics generation, light mixing, parametric oscillation and tertiary higher harmonics generation, which relate to conversion of wavelength, are important among the above noted effects.

Known embodiments of a wavelength-converting element using a semiconductor laser and a nonlinear optical material for use in the present invention include a single crystal light-wave guide type element and a fiber type element. The former light-wave guide type element includes a tabular wave guide type element as described in JP-A-51-142284, JP-A-52-108779 and JP-A-52-125286, an embedded wave guide type element as described in JP-A-60 57825, JP-A-60-14222 and JP-A-60-112023, and a taper wave guide type element as described in JP-A-60-250334. An example of a type element is desclosed in JP-A-57-211125 which describes a fiber type wavelength-converting element which satisfies the phase-matching condition between the incident laser wave and the converted laser wave.

Next, color development of the color photo graphic material of the present invention is described below.

The amount of the replenisher to be added to the color developer is 200 ml or less per $m^2$ of the photographic material being processed. Preferably, it is 120 ml or less, and more preferably 100 ml or less. According to the present invention continuous development can be conducted using a very small amount (for example, about 20 ml) of replenisher. The amount of the replenisher is the amount of the color developer to be replenished during color development of the photographic material of the present invention. The color developer replenishment amount does not include the amount of other additives to be replenished during the process to compensate for the concentration or deterioration of additives with the lapse of time. Such additives include, for example, water to be added so as to offset concentration processing solution, preservative which deteriorate over time, and alkali agents which are added to elevate the pH value of the processing system.

The color developer for use for development of the photographic material of the present invention is an alkaline aqueous solution mainly comprising an aromatic primary amine color developing agent. As the color developing agent, p-phenylenediamine compounds are preferred, although aminophenol compounds are also useful. Specific examples of such color developer agents include 3-methyl-4-amino-N,N-diethylaniline, 3-methyl-4-amino-N-ethyl-N-β-hydroethylaniline, 3-methyl-4-amino-N-ethyl-N-β-methanesulfonamidoethylaniline, 3-methyl-4-amino-N-ethyl-N-β-methoxyethylaniline and their sulfates, hydrochlorides and p-toluenesulfonates. The above compounds may be used in combination thereof.

The color developer for use in the present invention generally contains a pH buffer such as an alkali metal carbonate, borate or phosphate, and a development inhibitor or an antifoggant such as a bromide, iodide, benzimidazole, benzothiazole or mercapto compound. In addition, the color developer may further contain, if desired, various preservatives such as hydroxylamine, diethylhydroxylamine, sulfates, hydrazines, hydrazides, phenylsemicarbazides, triethanolamine, catecholsulfonic acids, triethylenediamine(1,4-diazabicyclo[2,2,-2]octanes). Above all, hydrazines and hydrazides are preferred, corresponding to the compounds represented by the formula (II) as described in Japanese Patent Application No. 63 11295, specific examples thereof being described at pages 27 to 47. The amount of the preservative compound to be added to the color developer is preferably from 0.01 to 50 g, more preferably from 0.1 to 30 g, per liter of the developer. The amount of hydroxylamines to be added is preferably up to 10 g, more preferably up to 5 g, per liter of the color developer. The amount of the additives is preferably minimized, provided that the stability of the color developer is maintained.

Other additives to the color developer of the present invention may include an organic solvent such as ethylene glycol or diethylene glycol; a development accelerator such as polyethylene glycol, quaternary ammonium salts and amines; a dye-forming coupler; a competing coupler; a foggant such as sodium boronhydride; a developing agent acid such as 1-phenyl-3-pyrazolidone; a tackifier, various kinds of chelating agents such as aminopolycarboxylic acids, aminopolyphosphonic acids, alkylphosphonic acids and phosphonocarboxylic acids. Such chelating agents include, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N'N'-tetramethylenephosphonic acid, ethylene diamine-di(o-hydroxyphenylacetic acid) and their salts.

In accordance with the present invention, the processing temperature of the color developer is preferably from 30° to 50° C., and more preferably from 33° to 42° C. The processing time is preferably not more than 1 minute. In order to lower the amount of the waste from the process, the amount of the replenisher is preferably reduced.

The color developer for use in the present invention does not substantially contain benzyl alcohol. The phase "substantially not containing benzyl alcohol" means that the content thereof in the developer is not more than 2 ml, more preferably not more than 0.5 ml per liter of the color developer solution, and most preferably it is absolutely not contained. The use of benzyl alcohol is disadvantageous because it results in environmental pollution, lowers the storage stability of color images formed and generates stain. The photographic material of the present invention is sufficiently rapidly processed with a color developer substantially not containing benzyl alcohol. In the substantial absence of benzyl alcohol, the photographic material of the present invention is preferably processed in a color development system comprising a restoring agent for the oxidation product of a color developing agent, as described in JP-A 63-113537, and a capturing agent for the oxidation product of the restoring agent.

In addition, the color developer for use in the present invention preferably does not substantially contain iodide ion. The phrase "not substantially containing iodide ion" means that the color developer contains iodide ion in an amount of less than 1 mg/liter. Further, the color developer for use in the present invention preferably does not substantially contain sulfite ion. The phrase "not substantially containing sulfite ion" means that the sulfite ion content in the developer is 0.02 mol/liter or less.

After being color development, the photographic emulsion layer of the photographic material of the present invention is generally bleached. Bleaching may be carried out simultaneously with fixation (bleach-fixation) or separately from the latter. In order to accelerate the photographic processing, bleaching may be followed by bleach fixation. In addition, bleach-fixation in continuous two processing tanks, fixation prior to bleach-fixation or bleach-fixation followed by bleaching may also be applied to the photographic materials of the present invention, in accordance with the object thereof. Bleaching agents for use in processing the photographic material of the present invention include, for example, compounds of polyvalent metals such as iron(III), cobalt(III), chromium(VI) or copper(II), as well as peracids, quinones and nitro compounds. Specific examples of the bleaching agent include ferricyanides; bichromates; organic complexes of iron(III) or cobalt(III), for example, complexes with aminopolycarboxylic acids such as ethylenediaminetetraacetic acid, diethylenetriamine-pentaacetic acid, cyclohexanediaminetetraacetic acid, methylimino-diacetic acid, 1,3-diaminopropane-tetraacetic acid or glycolether-diamine-tetraacetic acid, as well as with citric acid, tartaric acid or malic acid; persulfates; bromates; permanganates; and nitrobenzenes. Among them, aminopolycarboxylic acid/iron(III) complexes such as ethylenediamine-tetraacetic acid/iron(III) complex as well as persulfates are preferred in view of the rapid processability and for prevention of environmental pollution. The aminopolycarboxylic acid/ iron(III) complexes are especially useful, both in the bleaching solution and in the bleach-fixation solution. The bleaching solution or bleach-fixation solution containing such aminopolycarboxylic acid/iron(III) complexes generally has a pH value of from 5.5 to 8, but the solution may have a lower pH value to provide rapid processing.

The bleaching solution, bleach-fixation solution and a pre-bath may contain a bleach accelerating agent, if desired. Various bleach accelerating agents are known, and examples of the agents which are advantageously used in the present invention include the mercapto group or disulfide group-containing compounds described in U.S. Pat. No. 3,893,858, West German Patent 1,290,812, JP-A-53-95630 and *Research Disclosure,* item 17129 (July, 1978); the thiazolidine derivatives described in JP-A-50-14029; the thiourea derivatives described in U.S. Pat. No. 3,706,561; the iodides described in JP-A 58 16235; the polyoxyethylene compounds described in West German Patent 2,748,430; the polyamine compounds described in JP-B-45-8836; and bromide ion. Among them, the mercapto group or disulfido group-having compounds are preferred due to their high accelerating effect, and in particular, the compounds described in U.S. Pat. No. 3,893,858, West German Patent 1,290,812 and JP-A-53-95630 are particularly preferred. Further, the compounds described in U.S. Pat. No. 4,552,834 are also preferred. The bleach accelerating agents may also be incorporated into the photographic material of the present invention. When picture-taking color photographic materials for color prints are bleach-fixed, such bleach accelerators are especially effective.

The fixing agent for use in the present invention includes thiosulfates, thiocyanates, thioether compounds, thioureas and iodides in a large quantity. Among them, thiosulfates are generally used, and in particular, ammonium thiosulfate is most widely used. Preservatives for the bleach-fixation solution of the present invention include sulfites, bisulfites, sulfinic acids and carbonyl-bisulfite adducts are preferred.

The silver halide color photographic materials of the present invention are generally rinsed in water and/or stabilized, after being desilvered. The amount of the water to be used in the rinsing step is set in a broad range, depending on a the characteristic of the photographic material being processed (for example, depending upon the raw material components, such as the coupler, etc.) or the use of the material, as well as the temperature of the rinsing water, the number of the rinsing tanks (the number of the rinsing stages), the wash water replenishment system being either normal current or countercurrent, and other processing conditions. The relation between the number of the rinsing tanks and the amount of the rinsing water to be used in a multi-stage countercurrent rinsing system can be calculated by the method described in *Journal of the Society of Motion Picture and Television Engineers,* Vol. 64, pages 248 to 253 (May, 1955).

According to the multi stage countercurrent system described in the above-noted reference, the amount of the rinsing water to be used can be markedly reduced, but due to the increase of the residence time of the water in the rinsing tank, bacteria readily propagates in the tank. As a result, floating matter generated by the propagation of bacteria tends to adhere to the surface of the photographic material during processing. In the practice of processing the photographic materials of the present invention, a method of reducing calcium and magnesium ions, as described in JP-A-62-288838, effectively overcomes the problem of floating matter. In addition, the isothiazolone compounds and thiabendazoles described in JP-A-57-8542; chlorine-containing bactericides such as chlorinated sodium isocyanurates; and benzotriazoles and other bactericides described in H. Horiguchi, *Chemistry of Bactericidal and Fungicidal Agents,* and *Bactericidal and Fungicidal Techniques to Microorganisms and Antimolding Technique,* edited by Association of Sanitary Technique, Japan, and *Encyclopedia of Bactericidal and Antimolding Agents,* edited by Nippon Antimolding Association, can also be used.

The pH value of the rinsing water for use in processing the photographic materials of the present invention is from 4 to 9, and preferably from 5 to 8. The temperature of the rinsing water and the rinsing time is set depending on the characteristics of the photographic material being processed, as well as the use thereof. In general, the temperature is from 15° to 45° C. and the time is from 20 seconds to 10 minutes, and preferably the temperature is from 25° to 40° C. and the time is from 30 seconds to 5 minutes. Alternatively, the photographic materials of the present invention may also be processed directly with a stabilizing solution in place of being rinsed with water. For the stabilization, any known methods, as described, for example, in JP-A-57-8543, JP-A-58-14834 and JP-A-60-220345, can be employed.

In addition, the photographic material of the present invention can also be stabilized, following the rinsing step. One example thereof is a stabilizing bath containing formaldehyde and a surfactant, which is used as a final bath for picture taking color photographic materials. The stabilizing bath may also contain various chelating agents and antimolding agents.

The overflow from the rinsing and/or stabilizing solutions due to addition of replenishers thereto may be re-used in the other steps such as the previous desilvering step.

The silver halide color photographic materials of the present invention may contain a color developing agent for the purpose of simplifying and accelerating the processing of the materials. For incorporation of color developing agents into the photographic materials, various precursors of the agents are preferably used. For example, the indoaniline compounds described in U.S. Pat. No. 3,342,597, the Schiff base compounds described in U.S. Pat. No. 3,342,599 and *Research Disclosure* Items 14850 and 15159, the aldole compounds described in *Research Disclosure* Items 13924, the metal complexes described in U.S. Pat. No. 3,719,492 and the urethane compounds described in JP-A 53-135628, may be used as the precursors.

The silver halide color photographic material of the present invention can contain various 1-phenyl 3-pyrazolidones, if desired, for the purpose of accelerating the color development thereof. Specific examples of these compounds are described in JP-A-56-64339, JP-A-57-144547 and JP-A-58 115438.

The processing solutions for the photographic materials of the present invention are used at a temperature of from 10° C. to 50° C. A processing temperature of from 33° C. to 38° C. is standard, but the temperature may be increased to accelerate the processing or to shorten the processing time, or on the contrary, the temperature may be lowered to improve the quality of images formed and to improve the stability of the processing solutions used. For the purpose of economization of silver in the photographic materials, the cobalt intensification or hydrogen peroxide intensification as described in West German Patent 2,226,770 and U.S. Pat. No. 3,674,499 may be employed in the processing the photographic material of the present invention.

In the method of the present invention, the color development step can be completed within 120 seconds from color development to drying including desilvering and rinsing of the color photographic material.

The following non-limiting examples illustrate the method of the present invention.

EXAMPLE 1

Silver halide emulsion (1) was prepared in accordance with the process below, using the following Solution-1 to Solution-7.

| | |
|---|---|
| Solution-1: | |
| $H_2O$ | 1000 ml |
| NaCl | 3.3 g |
| Gelatin | 32 g |
| Solution-2: | |
| Sulfuric Acid (1N) | 24 ml |
| Solution-3: | |
| The following compound (A) | 3 ml |

-continued (1% of aqueous solution)

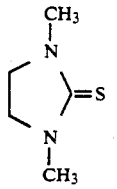

| | |
|---|---|
| Solution-4: | |
| NaCl | 10.5 g |
| KBr | 1.1 g |
| $H_2O$ to make | 200 ml |
| Solution-5: | |
| $AgNO_3$ | 32.00 g |
| $H_2O$ to make | 200 ml |
| Solution-6: | |
| NaCl | 41.8 g |
| KBr | 4.5 g |
| $H_2O$ to make | 560 ml |
| Solution-7: | |
| $AgNO_3$ | 128 g |
| $H_2O$ to make | 560 ml |

Solution-1 was heated at 50° C., and Solution-2 and Solution-3 were added thereto. Afterwards, Solution-4 and Solution-5 were simultaneously added thereto over a period of 9 minutes. After 10 minutes, Solution-6 and Solution-7 were also simultaneously added over a period of 15 minutes. 5 minutes after the addition, the temperature was lowered and the resulting product was desalted.

Water and gelatin for dispersion were added to the desalted product and the pH value was adjusted to 6.2. Accordingly, a monodispersed cubic silver chlorobromide emulsion having a mean grain size of 0.48 μm, and a variation coefficient (value obtained by dividing the standard deviation by the mean grain size, represented by $s/\bar{d}$) of 0.10 was obtained. Sodium thiosulfate was added to the emulsion at 58° C. for optimal chemical sensitization thereof to provide a surface latent image type emulsion.

The amounts of the ingredients in the Solution-1 to Solution-7 were varied and the reaction temperature was also varied as shown in Table 1. Accordingly, Emulsions Nos. 2 to 22 shown in Table 1 below were obtained. Iridium ion, rhodium ion or iron ion were blended with Solution-6 in the form of an aqueous solution of iridium(III) chloride, potassium hexachlororhodate or yellow prussiate of potash, respectively, as shown in Table 1.

TABLE 1

| Emulsion | Cl- Content (mol %) | Size (μm) | Variation Coefficient | Metal Ion | Amount of Metal Ion Added (mol/mol—Ag) |
|---|---|---|---|---|---|
| 1 | 95 | 0.48 | 0.10 | — | — |
| 2 | 95 | 0.48 | 0.10 | Iridium | $1 \times 10^{-10}$ |
| 3 | 95 | 0.48 | 0.10 | " | $1 \times 10^{-9}$ |
| 4 | 95 | 0.48 | 0.10 | " | $1 \times 10^{-8}$ |
| 5 | 95 | 0.48 | 0.10 | " | $1 \times 10^{-3}$ |
| 6 | 95 | 0.48 | 0.10 | " | $1 \times 10^{-2}$ |
| 7 | 95 | 0.48 | 0.10 | Rhodium | $1 \times 10^{-10}$ |
| 8 | 95 | 0.48 | 0.10 | " | $1 \times 10^{-9}$ |
| 9 | 95 | 0.48 | 0.10 | " | $1 \times 10^{-3}$ |
| 10 | 95 | 0.48 | 0.10 | " | $1 \times 10^{-2}$ |
| 11 | 95 | 0.48 | 0.10 | Iron | $1 \times 10^{-10}$ |
| 12 | 95 | 0.48 | 0.10 | " | $1 \times 10^{-9}$ |
| 13 | 95 | 0.48 | 0.10 | " | $1 \times 10^{-3}$ |

TABLE 1-continued

| Emulsion | Cl-Content (mol %) | Size (μm) | Variation Coefficient | Metal Ion | Amount of Metal Ion Added (mol/mol—Ag) |
|---|---|---|---|---|---|
| 14 | 95 | 0.48 | 0.10 | " | $1 \times 10^{-2}$ |
| 15 | 95 | 1.01 | 0.08 | — | — |
| 16 | 95 | 1.01 | 0.08 | Iridium | $1 \times 10^{-8}$ |
| 17 | 95 | 0.48 | 0.10 | " | $1 \times 10^{-8}$ |
| 18 | 70 | 0.48 | 0.10 | — | — |
| 19 | 70 | 0.48 | 0.10 | Iridium | $1 \times 10^{-10}$ |
| 20 | 70 | 0.48 | 0.10 | " | $1 \times 10^{-9}$ |
| 21 | 70 | 0.48 | 0.10 | " | $1 \times 10^{-3}$ |
| 22 | 70 | 0.48 | 0.10 | " | $1 \times 10^{-2}$ |

A multilayer color photographic paper (Sample A) was prepared by coating the plural layers described below on a paper support, both surfaces of which were coated with polyethylene. The coating compositions were prepared as given below.

Preparation of Coating Composition for First Layer:

27.2 ml of ethyl acetate and 7.7 ml of solvent (Solv-1) were added to 19.1 g of yellow coupler (E×Y) and 4.4 g of color image stabilizer (Cpd-1) and dissolved. The resulting solution was dispersed by emulsification in 185 ml of aqueous 10% gelatin solution containing 8 ml of 10% sodium dodecylbenzenesulfonate. On the other hand, the following blue-sensitizing dye was added to silver chloride emulsion (16) in an amount of $5.0 \times 10^{-4}$ mol per mol of silver. The previous emulsified dispersion and the emulsion containing the blue-sensitizing dye were blended and dissolved to obtain a first layer-coating composition comprising the components described below. The other coating compositions for the second to seventh layers were prepared in a similar manner as above. 1-hydroxy-3,5 dichloro-s-triazine sodium salt was used as the gelatin-hardening agent for each layer.

The following spectral sensitizing dyes were used for the emulsion layers.

Blue-Sensitive Emulsion Layer:

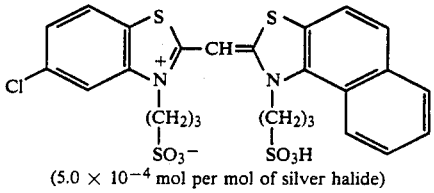

($5.0 \times 10^{-4}$ mol per mol of silver halide)

Green-Sensitive Emulsion Layer:

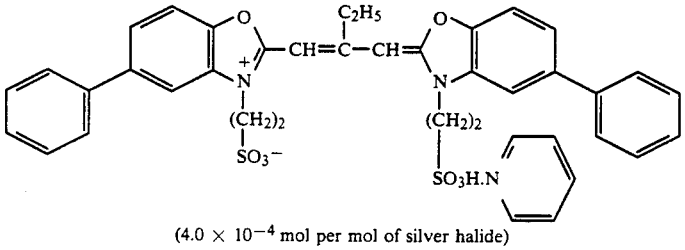

($4.0 \times 10^{-4}$ mol per mol of silver halide)

and

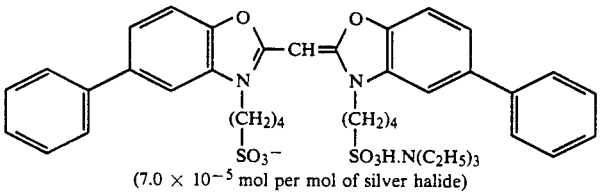

($7.0 \times 10^{-5}$ mol per mol of silver halide)

Red-Sensitive Emulsion Layer:

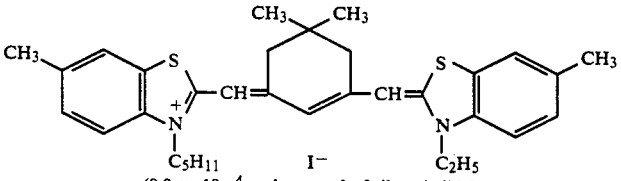

($0.9 \times 10^{-4}$ mol per mol of silver halide)

The following compound was added to the red-sensitive emulsion layer in an amount of $2.6 \times 10^{-3}$ mol per mol of silver halide for supersensitizing and the like.

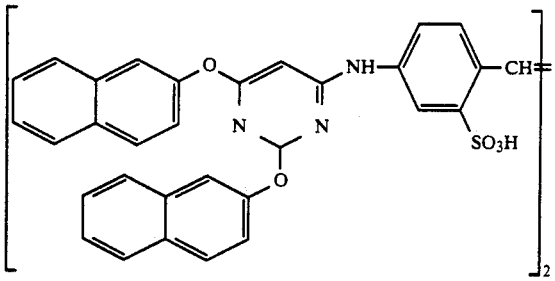

To the blue-sensitive, green-sensitive and red-sensitive emulsion layers was added 1-(5-methylureidophenyl)-5-mercaptotetrazole each in an amount of $8.5\times10^{-5}$ mol, $7.7\times10^{-4}$ mol and $2.5\times10^{-4}$ mol, respectively, per mol of silver halide as an antifoggant or a storage stabilizing agent.

The following dyes were added to the emulsion layers for anti-irradiation in an amount of 15 mg/m$^2$, respectively.

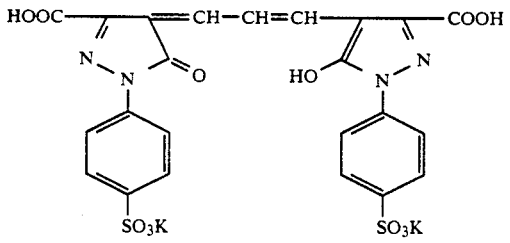

and

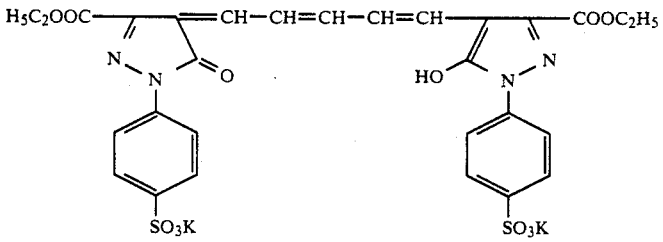

Layer Constitution

The composition of each layer was as shown below. The amount of each component coated is represented in unit of g/m$^2$. The amount of the silver halide emulsion is represented by the amount of silver coated.

| | |
|---|---|
| Support: | |
| Polyethylene-Laminated Paper (containing white pigment ($TiO_2$) and blueish dye (ultramarine) in the polyethylene below the first layer). | |
| First Layer: Blue-Sensitive Layer | |
| Silver halide emulsion (16) | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Second Layer: Color Mixing Preventing Layer | |
| Gelatin | 0.99 |
| Color Mixing preventing agent (Cpd-2) | 0.08 |
| Third Layer: Green-Sensitive Layer | |
| Silver halide emulsion (1) | 0.36 |
| Gelatin | 1.24 |
| Magenta coupler (ExM) | 0.31 |
| Color image stabilizer (Cpd-3) | 0.25 |
| Color image stabilizer (Cpd-7) | 0.12 |
| Solvent (Solv-2) | 0.42 |
| Fourth Layer: Ultraviolet Absorbent Layer | |
| Gelatin | 1.58 |
| Ultraviolet absorbent (UV-1) | 0.62 |
| Color mixing preventing agent (Cpd-4) | 0.05 |
| Solvent (Solv-3) | 0.24 |
| Fifth Layer: Red-Sensitive Layer | |
| Silver halide emulsion (4) | 0.23 |
| Gelatin | 1.34 |
| Cyan coupler (ExC) | 0.34 |
| Color image stabilizer (Cpd-5) | 0.17 |
| Polymer (Cpd-6) | 0.40 |
| Solvent (Solv-4) | 0.23 |
| Sixth Layer: Ultraviolet Absorbing Layer | |
| Gelatin | 0.53 |
| Ultraviolet absorbent (UV-1) | 0.21 |
| Solvent (Solv-3) | 0.08 |
| Seventh Layer: Protective Layer | |
| Gelatin | 1.33 |
| Acryl-modified copolymer of polyvinyl alcohol (modification degree 17%) | 0.17 |
| Liquid paraffin | 0.03 |

The additives used above had the following chemical structural formulae.

(Cpd-1) Color Image Stabilizer:

-continued
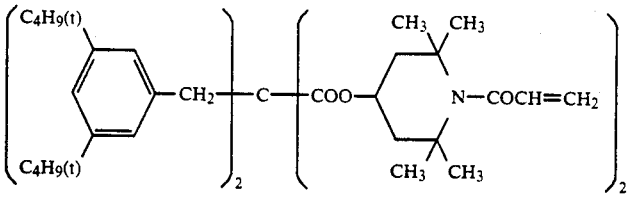
(Cpd-2) Color Mixing Preventing Agent:
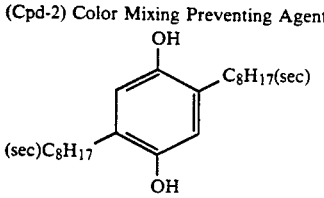
(Cpd-3) Color Image Stabilizer:
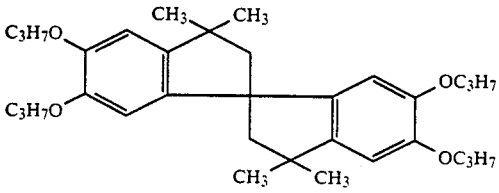
(Cpd-4) Color Mixing Preventing Agent:
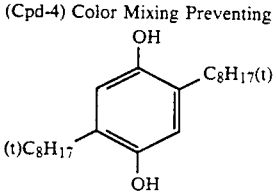
(Cpd-5) Color Image Stabilizer:
5/8/9 (by weight) mixture of the following compounds.
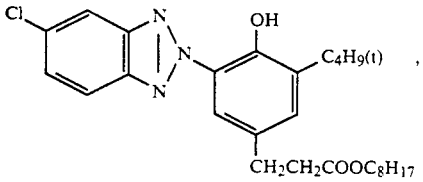
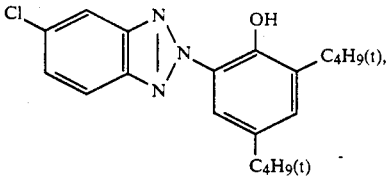
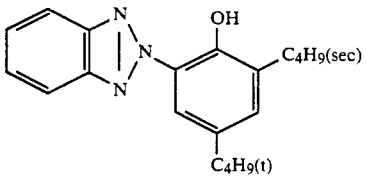
(Cpd-6) Polymer
$(CH_2-CH)_n$
|
$CONHC_4H_9(t)$
(mean molecular weight: 80,000)
(Cpd-7) Color Image Stabilizer:

-continued
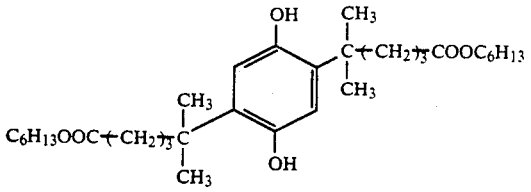
(UV-1) Ultraviolet Absorbent:
2/9/8 (by weight) mixture of the following compounds:
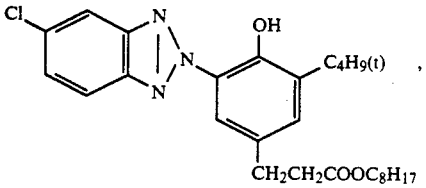
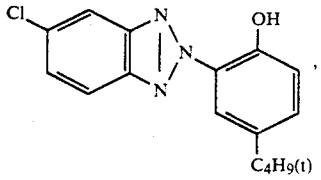
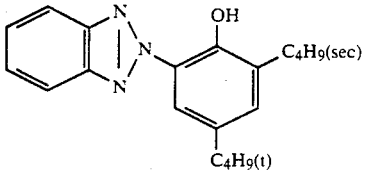
(Solv-1) Solvent:
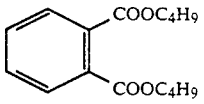
(Solv-2) Solvent:
2/1 (by volume) mixture of the following compounds
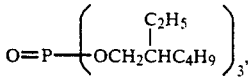
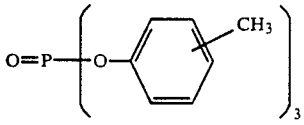
(Solv-3) Solvent:
$O{=}P{\leftarrow}O{-}C_9H_{19}(iso))_3$
(Solv-4) Solvent:
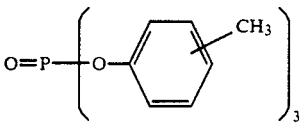
(ExY-1) Yellow coupler:

-continued

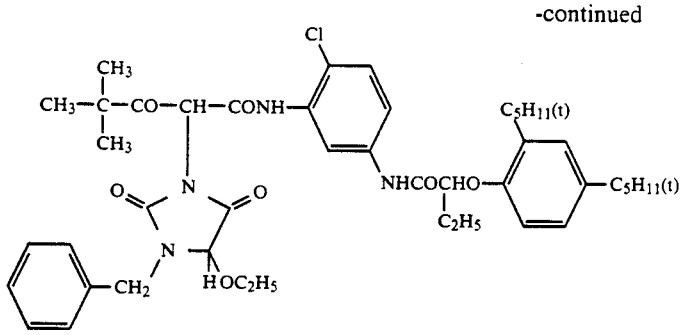

(ExM) Magenta coupler:

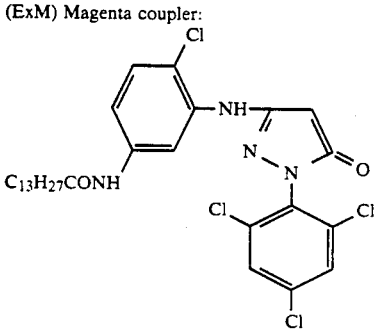

(ExC-1) Cyan coupler:

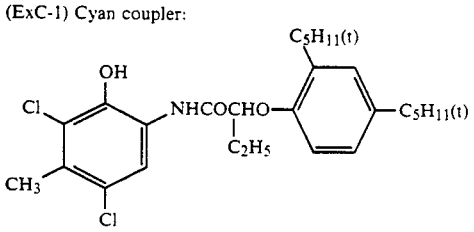

Samples (B) to (U) were prepared in the same manner as above, except that the emulsions in the first, third and fifth layers were varied as indicated in Table 2 below.

TABLE 2

| Sample Code | Emulsion in 1st Layer | Emulsion in 3rd Layer | Emulsion in 5th Layer |
|---|---|---|---|
| A | (16) | (1) | (4) |
| B | (16) | (2) | (4) |
| C | (16) | (3) | (4) |
| D | (16) | (4) | (4) |
| E | (16) | (5) | (4) |
| F | (16) | (6) | (4) |
| G | (16) | (7) | (4) |
| H | (16) | (8) | (4) |
| I | (16) | (9) | (4) |
| J | (16) | (10) | (4) |
| K | (16) | (11) | (4) |
| L | (16) | (12) | (4) |
| M | (16) | (13) | (4) |
| N | (16) | (14) | (4) |
| O | (16) | (18) | (4) |
| P | (16) | (19) | (4) |
| Q | (16) | (20) | (4) |
| R | (16) | (21) | (4) |
| S | (16) | (22) | (4) |
| T | (16) | *(4)/(17) | (4) |
| U | (15) | (4) | (1) |

Note:
*Mixture of Emulsion (4)/Emulsion (17) of 6/4 by the amount of silver.

An exposing apparatus having the following components was used.

As a semiconductor laser source, GaAs (oscillation wavelength, about 920 nm) and InGaAs (oscillation wavelength, about 1300 nm) were used and synthesized with a dichroic mirror. The laser thus produced was introduced into a fiber type element where a nonlinear optical material of PRA (3,5-dimethyl-1-(4-nitrophenyl)pyrazole was crystallized in glass fibers, and the secondary higher harmonics of the two waves (460 nm, 650 nm), and the sum frequency (539 nm) of the two waves were removed therefrom. The thus wavelength-converted laser rays of blue, green and red light were applied to a rotating polyhedron having a filter so that the color photographic paper moving vertically to the scanning direction was exposed with the laser rays in order scanning exposure.

Using the above described exposing apparatus, the photographic paper samples were sensitometrically exposed. The thus exposed samples were processed with a color developer having the composition described below. The photographic properties of the processed sample were evaluated at two times. That is, a first sample was evaluated before the start of continuous processing, and a second sample was evaluated after continuous processing to the extent that the amount of the replenisher consumed was two times the tank capacity. For evaluating the photographic properties, the maximum density (Dmax) and the gradation (difference of density between a point having a density of 0.5 and a point having a higher density than the former by 0.3 as logE) in each of the blue, green and red portions were determined with Macbeth Densitometer. The variation between the measured data of the first evaluation (before the strt of continuous processing) and the second evaluation (after continuous processing) was calculated. The results obtained are shown in Table 3 below.

Photographic Processing:

| Step | Temperature | Time | Amount of Replenisher* | Tank Capacity |
|---|---|---|---|---|
| Color Development | 35° C. | 45 sec | 108 ml | 17 l |
| Bleach-fixation | 30 to 26° C. | 45 sec | 161 ml | 17 l |
| Rinsing (1) | 30 to 37° C. | 20 sec | — | 10 l |
| Rinsing (2) | 30 to 37° C. | 20 sec | — | 10 l |
| Rinsing (3) | 30 to 37° C. | 20 sec | — | 10 l |
| Rinsing (4) | 30 to 37° C. | 30 sec | 248 ml | 10 l |
| Drying | 70 to 80° C. | 60 sec | | |

Note:

*Per $m^2$ of photographic material processed.

Rinsing was effected by four-tank cascade flow system from rinsing bath (4) to rinsing bath (1).

The processing solutions used had the following compositions.

| | Tank Solution | Replenisher |
|---|---|---|
| Color Developer: | | |
| Water | 800 ml | 800 ml |
| Ethylenediamine-N,N,N',N'-tetramethylenephosphonic acid | 3.0 g | 3.0 g |
| Triethanolamine | 10 g | 10 g |
| Hydrazino-N,N-diacetic acid | 3.5 g | 7.0 g |
| Potassium bromide | 0.015 g | — |
| Sodium chloride | 3.1 g | — |
| Potassium carbonate | 25 g | 25 g |
| N-ethyl-N-(β-methanesulfonamidoethyl)-3-methyl-4-aminoaniline sulfate | 5.0 g | 9.5 g |
| Brightening agent (WHITEX 4, by Sumitomo Chemical, Japan) | 2.0 g | 2.5 g |
| Water to make | 1000 ml | 1000 ml |
| pH (25° C.) | 10.05 | 10.60 |
| Bleach-Fixing Solution: | | |
| The tank solution and replenisher were same. | | |
| Water | | 400 ml |
| Ammonium Thiosulfate (70% aqueous solution) | | 100 ml |
| Ammonium sulfite | | 17 g |

-continued

| | Tank Solution | Replenisher |
|---|---|---|
| Ammonium Ethylenediaminetetra-acetate/Iron (III) | | 55 g |
| Disodium Ethylenediaminetetra-acetate | | 5 g |
| Ammonium bromide | | 40 g |
| Glacial acetic acid | | 9 g |
| Water to make | | 1000 ml |
| pH (25° C.) | | 5.40 |

Rinsing Solution

The tank solution and replenisher were same.

City water was passed through a mixed bed column filled with H-type strong acidic cationic exchange resin (Amberlite IR-120B, by Rhom & Haas Co.) and OH-type strong basic anionic exchange resin (Amberlite IRA-400, by Rhom & Haas Co.) whereby the calcium concentration and magnesium concentration were reduced to 3 mg/liter, respectively, and then 20 mg/liter of sodium dichloroisocyanurate and 150 mg/liter of sodium sulfate were added to the thus processed water.

The rinsing water had a pH value of from 6.5 to 7.5. In the process of Example 1, the amount of the carry-over of the bleach-fixing solution to the rinsing step was 40 ml per $m^2$ of the photographic material processed.

TABLE 3

| Sample No. | Photographic Property: Blue ΔDmax | Blue ΔGradation | Green ΔDmax | Green ΔGradation | Red ΔDmax | Red ΔGradation |
|---|---|---|---|---|---|---|
| A | −0.08 | −0.07 | −0.22 | −0.19 | −0.12 | −0.06 |
| B | −0.09 | −0.07 | −0.22 | −0.19 | −0.11 | −0.05 |
| C | −0.08 | −0.07 | −0.14 | −0.07 | −0.11 | −0.06 |
| D | −0.09 | −0.07 | −0.12 | −0.06 | −0.11 | −0.06 |
| E | −0.09 | −0.07 | −0.11 | −0.05 | −0.11 | −0.06 |
| F | −0.08 | −0.06 | −0.15 | −0.07 | −0.10 | −0.07 |
| G | −0.08 | −0.06 | −0.22 | −0.19 | −0.11 | −0.06 |
| H | −0.08 | −0.08 | −0.12 | −0.07 | −0.10 | −0.07 |
| I | −0.08 | −0.06 | −0.12 | −0.05 | −0.12 | −0.08 |
| J | −0.08 | −0.06 | −0.15 | −0.07 | −0.11 | −0.09 |
| K | −0.08 | −0.07 | −0.22 | −0.19 | −0.12 | −0.07 |
| L | −0.09 | −0.07 | −0.17 | −0.10 | −0.10 | −0.07 |
| M | −0.08 | −0.07 | −0.14 | −0.05 | −0.11 | −0.06 |
| N | −0.09 | −0.07 | −0.16 | −0.08 | −0.11 | −0.05 |

TABLE 3-continued

| Sample No. | Photographic Property: Blue ΔDmax | Blue ΔGradation | Green ΔDmax | Green ΔGradation | Red ΔDmax | Red ΔGradation |
|---|---|---|---|---|---|---|
| O | −0.08 | −0.08 | −0.22 | −0.20 | −0.12 | −0.07 |
| P | −0.09 | −0.08 | −0.21 | −0.19 | −0.13 | −0.08 |
| Q | −0.08 | −0.09 | −0.21 | −0.18 | −0.12 | −0.07 |
| R | −0.08 | −0.07 | −0.21 | −0.18 | −0.12 | −0.07 |
| S | −0.08 | −0.08 | −0.21 | −0.18 | −0.12 | −0.07 |
| T | −0.08 | −0.08 | −0.12 | −0.05 | −0.12 | −0.07 |
| U | −0.17 | −0.15 | −0.12 | −0.05 | −0.21 | −0.19 |

[ ]: Scope of the Present Invention

The results in Table 3 demonstrate that the variation in the photographic properties between the sample processed with a fresh developer (before the start of continuous processing) and a second sample processed with an aged developer (after continuous processing), was almost negligible in the case of the present invention, as compared with the comparative samples where no metal ion was added to the photographic material samples, or where some metal ion was added, but the silver chloride content in the samples was lower than 95 mol %.

When the amount of the replenisher to the developer was 300 ml per $m^2$ of the photographic material processed, the measured variation in Dmax and gradation was small.

EXAMPLE 2

Emulsion (23) to (47) shown in Table 4 below were prepared in the same manner as in Example 1. Specifically, emulsions (31) to (45) were prepared in accordance with the method described in European Patent Laid-Open No. 0,273,430, whereupon the following compound (B) was added in an amount of $4.0\times10^{-4}$ mol per mol of silver halide prior to chemical sensitization with sodium thiosulfate and thereafter ultra fine silver bromide grains (grain size 0.05 μ) were added in an amount of 1 mol % based on the silver content, and the emulsion was ripened for 10 minutes at 58° C.

By X-ray diffraction, electromicroscopic observation and EDX methods, emulsions (31) to (45) were ascertained to have a silver bromide-locallized phase having a silver bromide content of 60 mol % or less near the apexes of the grains.

For addition of the metal ion to emulsions (24) to (42) and (46) to (47), the same compound as used in Example 1 was added to Solution-6.

For addition of the metal ion to emulsions (43) to (45), the same compound as used in Example 1 was previously incorporated into the ultra-fine silver bromide grains in accordance with the method of EP 0,273,430.

Compound (B) as noted above, has the following structural formula.

Compound (B):

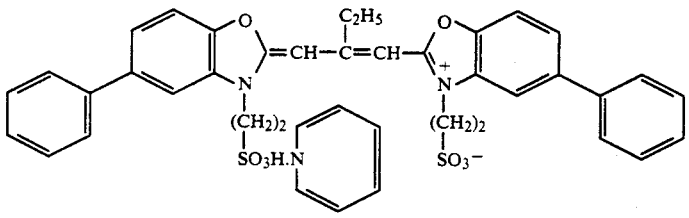

TABLE 4

| Emulsion No. | Cl-Content (mol %) | Grain Size (μm) | Variation Coefficient | Metal Ion | Amount of Metal Ion Added (mol/mol—Ag) |
|---|---|---|---|---|---|
| 23 | 70 | 0.48 | 0.10 | — | — |
| 24 | 70 | 0.48 | 0.10 | Iridium | $1\times10^{-8}$ |
| 25 | 70 | 0.48 | 0.10 | Rhodium | $1\times10^{-8}$ |
| 26 | 70 | 0.48 | 0.10 | Iron | $1\times10^{-6}$ |
| 27 | 95 | 0.48 | 0.10 | — | — |
| 28 | 95 | 0.48 | 0.10 | Iridium | $1\times10^{-8}$ |
| 29 | 95 | 0.48 | 0.10 | Rhodium | $1\times10^{-8}$ |
| 30 | 95 | 0.48 | 0.10 | Iron | $1\times10^{-6}$ |
| 31 | 95* | 0.48 | 0.10 | — | — |
| 32 | 95* | 0.48 | 0.10 | Iridium | $1\times10^{-8}$ |
| 33 | 95* | 0.48 | 0.10 | Rhodium | $1\times10^{-8}$ |
| 34 | 95* | 0.48 | 0.10 | Iron | $1\times10^{-6}$ |
| 35 | 99* | 0.48 | 0.10 | — | — |
| 36 | 99* | 0.48 | 0.10 | Iridium | $1\times10^{-9}$ |
| 37 | 99* | 0.48 | 0.10 | Iridium | $1\times10^{-8}$ |
| 38 | 99* | 0.48 | 0.10 | Iridium | $1\times10^{-4}$ |
| 39 | 99* | 0.48 | 0.10 | Iridium | $1\times10^{-3}$ |
| 40 | 99* | 0.48 | 0.10 | Iridium | $1\times10^{-2}$ |
| 41 | 99* | 0.48 | 0.10 | Rhodium | $1\times10^{-8}$ |
| 42 | 99* | 0.48 | 0.10 | Iron | $1\times10^{-6}$ |
| 43 | 99** | 0.48 | 0.10 | Iridium | $1\times10^{-8}$ |
| 44 | 99** | 0.48 | 0.10 | Rhodium | $1\times10^{-8}$ |
| 45 | 99** | 0.48 | 0.10 | Iron | $1\times10^{-6}$ |
| 46 | 100 | 0.48 | 0.10 | Rhodium | $1\times10^{-8}$ |
| 47 | 100 | 0.48 | 0.10 | Iridium | $1\times10^{-8}$ |

Note:
* **Grains have a silver bromide-locallized phase with silver bromide content of 60 mol % near the apexes of the grain.
**Grains have the metal ion in the silver bromide-locallized phase.

Samples (23) to (47) were prepared in the same manner as in Example 1, except that the emulsion in the green-sensitive emulsion layer of Sample (A) was replaced by emulsions (23) to (47), respectively. However, when emulsions (31) to (45) were used, the green-sensitizing dye was not added in preparing the coating composition.

The thus prepared samples were exposed in the same manner as in Example 1, except that the following compound TRI was used as the nonlinear optical material.

TRI

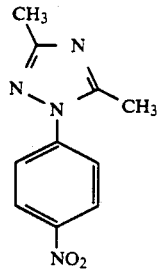

After exposure, the samples were processed as described below, and the variation of the photographic properties between the sample processed with a fresh developer (before the start of continuous processing) and that processed with an aged developer (after continuous processing) were evaluated.

| Photographic Processing: | | | | |
|---|---|---|---|---|
| Step | Temperature | Time | Amount of Replenisher* | Tank Capacity |
| Color Development | 38° C. | 45 sec | 90 ml | 8 l |
| Bleach-Fixation | 30 to 36° C. | 45 sec | 161 ml | 8 l |
| Rinsing (1) | 30 to 37° C. | 30 sec | — | 4 l |
| Rinsing (2) | 30 to 37° C. | 30 sec | — | 4 l |
| Rinsing (3) | 30 to 37° C. | 30 sec | 200 ml | 4 l |
| Drying | 70 to 80° C. | 60 sec | | |

Note:
*Per $m^2$ of photographic material processed.
Rinsing was effected by a three-tank counter flow system from rinsing bath (3) to rinsing bath (1).

The processing solutions used had the following compositions.

| | Tank Solution | Replenisher |
|---|---|---|
| Color Developer: | | |
| Water | 800 ml | 800 ml |
| Ethylenediamine-N,N,N,N-tetramethylenephosphonic acid | 3.0 g | 6.0 g |
| N,N-bis(carboxymethyl)hydrazine (organic preservative) | 0.03 mol | 0.07 mol |
| Sodium chloride | 4.2 g | — |
| Potassium carbonate | 25 g | 25 g |
| N-ethyl-N-(β-methanesulfon amidoethyl)-3-methyl-4-aminoaniline sulfate | 5.0 g | 11.0 g |
| Triethanolamine | 10.0 g | 10.0 g |
| Brightening Agent (4,4'-diaminostilbene type) | 2.0 g | 4.0 g |
| Water to make | 1000 ml | 1000 ml |
| pH (25° C.) | 10.05 | 10.85 |
| Bleach-fixing Solution: | | |
| Tank solution and replenisher were same. | | |
| Water | | 400 ml |
| Ammonium thiosulfate (70% aqueous solution) | | 100 ml |
| Sodium sulfite | | 17 g |
| Ammonium ethylenediaminetetraacetate/Iron (III) | | 55 g |
| Disodium ethylenediaminetetraacetate | | 5 g |
| Ammonium bromide | | 40 g |
| Glacial acetic acid | | 9 g |
| Water to make | | 1000 ml |
| pH (25° C.) | | 5.40 |

Rinsing Solution

The tank solution and replenisher were same.

Ion-Exchanged Water (Content of calcium and that of magnesium were each 3 ppm or less)

The values of Dmax and gradation were measured through a green filter and the results obtained are shown in Table 5 below.

TABLE 5

| Sample | Green ΔDmax | Green ΔGradation |
|---|---|---|
| 23 | −0.31 | −0.28 |
| 24 | −0.17 | −0.12 |
| 25 | −0.18 | −0.13 |
| 26 | −0.17 | −0.12 |
| 27 | −0.30 | −0.28 |
| 28 | −0.08 | −0.06 |
| 29 | −0.07 | −0.07 |
| 30 | −0.08 | −0.05 |
| 31 | −0.31 | −0.29 |
| 32 | −0.06 | −0.04 |
| 33 | −0.07 | −0.04 |
| 34 | −0.06 | −0.04 |
| 35 | −0.30 | −0.28 |
| 36 | −0.05 | −0.04 |
| 37 | −0.04 | −0.04 |
| 38 | −0.05 | −0.04 |
| 39 | −0.04 | −0.04 |
| 40 | −0.05 | −0.04 |
| 41 | −0.04 | −0.04 |
| 42 | −0.04 | −0.04 |
| 43 | −0.03 | −0.02 |
| 44 | −0.03 | −0.03 |
| 45 | −0.03 | −0.02 |
| 46 | −0.04 | −0.03 |
| 47 | −0.03 | −0.02 |

□: Scope of the Present Invention

As is clear from the results shown in Table 5, the variation of the photographic properties between the sample processed with a fresh developer (before the start of continuous processing), and that processed with an aged developer (after continuous processing), was almost negligible only when the sample was processed in accordance with the method of the present invention.

As can be seen in Table 5, the variation of the maximum color density (Dmax) and the variation of the gradation are effectively minimized in accordance with the method of the present invention such that color prints having stabilized photographic properties are thereby obtained.

EXAMPLE 3

In the same manner as Examples 1 and 2, the following silver chlorobromide emulsions Nos. 48 to 56 were prepared; provided that, in preparation of emulsions Nos. 48 to 52, a fine silver bromide grain emulsion (grain size: 0.05 μ) was added in an amount of 1 mol % on the basis of silver after preparation of a pure silver chloride emulsion but before addition of sodium thiosulfate for chemical sensitization. All the emulsions were chemically sensitized to the optimal degree so as to obtain surface latent image-type emulsions. To these emulsions was added a stabilizer of 1-(5-methylureidophenyl)-5-mercaptotetrazole in an amount of $5.0\times10^{-4}$ mol per mol of silver.

TABLE

| Emulsion No. | Cl-Content (mol %) | Size (μm) | Variation Coefficient | Metal Ion | Amount of Metal Ion Added (mol/mol—Ag) |
|---|---|---|---|---|---|
| 48 | 99* | 0.45 | 0.08 | Iridium | $1\times10^{-8}$ |
| 49 | 99* | 0.45 | 0.08 | — | — |
| 50 | 99** | 0.45 | 0.08 | Iridium | $1\times10^{-8}$ |
| 51 | 99** | 0.45 | 0.08 | Iron | $1\times10^{-6}$ |
| 52 | 99** | 0.45 | 0.08 | Rhodium | $1\times10^{-8}$ |
| 53 | 95 | 0.45 | 0.08 | Iridium | $1\times10^{-8}$ |
| 54 | 95 | 0.45 | 0.08 | — | — |
| 55 | 70 | 0.45 | 0.08 | Iridium | $1\times10^{-8}$ |
| 56 | 70 | 0.45 | 0.08 | — | — |

*, **The grain has a silver bromide localized phase with Br-content of 60 mol % near the apices thereof.
*The silver bromide localized phase contain the metal ion.

To the other emulsions, the metal ion was added during formation of the silver chloride grains.

Next, color coupler-containing dispersion were prepared by emulsification and were combined with the previously per pared silver halide emulsions as indicated in Table 6 below. The resulting compositions were coated on a paper support both surfaces of which were coated with polyethylene to prepare various kinds of multilayer color photographic materials each having the layer constitution as indicated in Table 6.

The layer constitution of the samples was as follows:

The amount of the component coated was represented by the unit of g/m² (or ml/m² for solvent). For the silver halide the amount was represented as the amount of silver therein.

Support:

Polyethylene-Laminated Paper (containing white pigment ($TiO_2$) and blueish dye (ultramarine) in the polyethylene below the first emulsion layer).

-continued

| | |
|---|---|
| First Layer: Yellow-Coloring Layer | |
| Silver halide emulsion (Table 6) | 0.30 |
| Spectral Sensitizing Dye (Table 6) | |
| Yellow Coupler (Y-1) | 0.82 |
| Color Image Stabilizer (Cpd-14) | 0.09 |
| Solvent (Solv-10) | 0.28 |
| Gelatin | 1.75 |
| Second Layer: Color Mixing Preventing Layer | |
| Gelatin | 1.25 |
| Filter Dye (Dye-a) | 0.01 |
| Color Mixing Preventing Agent (Cpd-11) | 0.11 |
| Solvent (Solv-6) | 0.24 |
| Solvent (Solv-9) | 0.26 |
| Third Layer: Magenta-Coloring Layer | |
| Silver halide emulsion (Table 6) | 0.12 |
| Spectral Sensitizing Dye (Table 6) | |
| Magenta Coupler (M-1) | 0.13 |
| Magenta Coupler (M-2) | 0.09 |
| Color Image Stabilizer (Cpd-8) | 0.15 |
| Color Image Stabilizer (Cpd-15) | 0.02 |
| Color Image Stabilizer (Cpd-16) | 0.03 |
| Solvent (Solv-5) | 0.34 |
| Solvent (Solv-6) | 0.17 |
| Gelatin | 1.25 |
| Fourth Layer: Ultraviolet Absorbing Layer | |
| Gelatin | 1.58 |
| Filter Dye (Dye-b) | 0.03 |
| Ultraviolet absorbent (UV-2) | 0.47 |
| Color Mixing Preventing Agent (Cpd-11) | 0.05 |
| Solvent (Solv-7) | 0.26 |
| Fifth Layer: Cyan-Coloring Layer | |
| Silver Halide Emulsion (Table 6) | 0.23 |
| Spectral Sensitizing Dye (Table 6) | |
| Cyan Coupler (C-1) | 0.32 |
| Color Image Stabilizer (Cpd-12) | 0.17 |
| Color Image Stabilizer (Cpd-13) | 0.04 |
| Color Image Stabilizer (Cpd-14) | 0.40 |
| Solvent (Solv-8) | 0.15 |
| Gelatin | 1.34 |
| Sixth Layer: Ultraviolet Absorbing Layer | |
| Gelatin | 0.53 |
| Ultraviolet Absorbent (UV-2) | 0.16 |
| Color Mixing Preventing Agent (Cpd-11) | 0.02 |
| Solvent (Solv-7) | 0.09 |
| Seventh Layer: Protective Layer | |
| Gelatin | 1.33 |
| Acryl-modified Copolymer of Polyvinyl Alcohol (modification degree 17%) | 0.17 |
| Liquid paraffin | 0.03 |

As the gelatin hardening agent for each layer, 1-hydroxy-3,5-dichloro-s-triazine sodium salt was added in an amount of 14.0 mg per g of gelatin.

The compounds used above were as follows:

Yellow Coupler (Y-1):

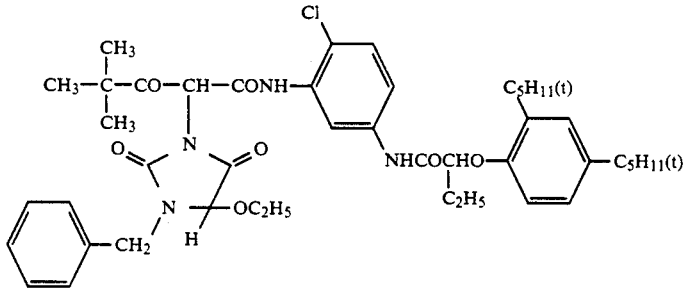

Cyan Coupler (C-1):

2/4/4 (by weight) mixture of the following compound.

-continued
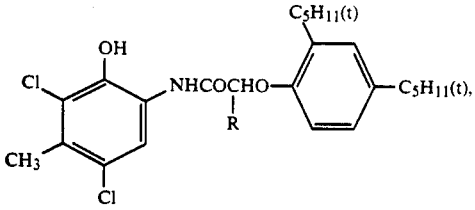
(R = $C_2H_5$)
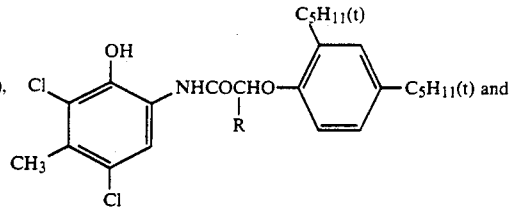
(R = $C_4H_9$)
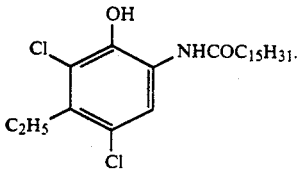
Magenta Coupler (M-1)
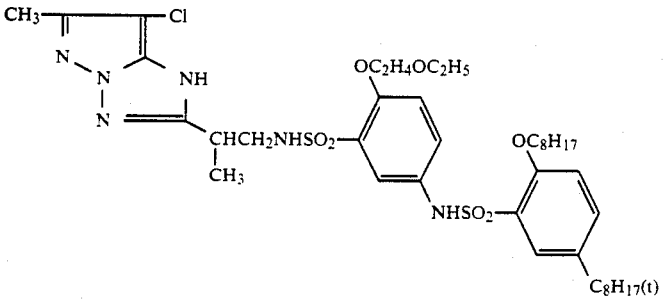
Magenta Coupler (M-2)
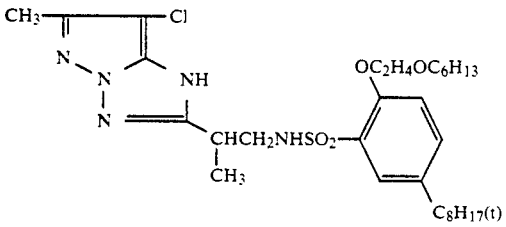
Color Image Stabilizer (Cpd-8):
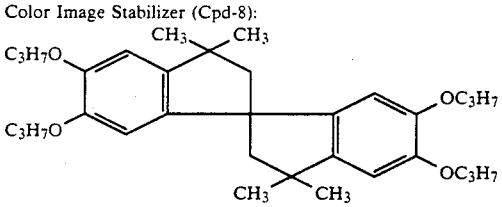
Color Image Stabilizer (Cpd-9):
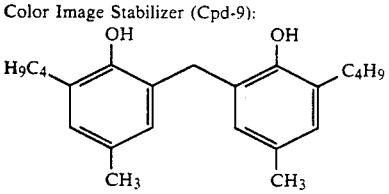
Color Image Stabilizer (Cpd-10):
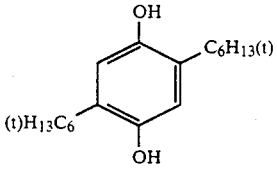
Color Mixing Preventing Agent (Cpd-11):
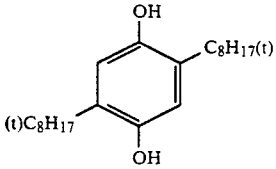
Color Image Stablilizer (Cpd-12):
2/4/4 (by weight) mixture of the following compound.
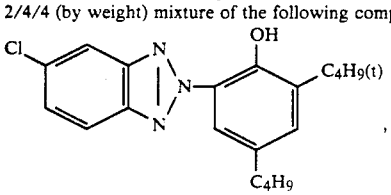
,
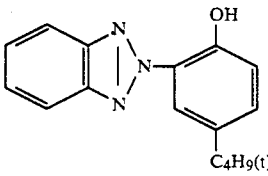
and
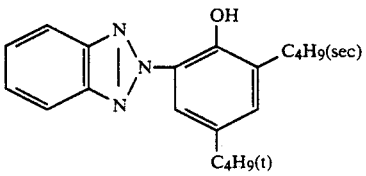
Color Image Stabilizer (Cpd-13):
Color Image Stabilizer (Cpd-14):

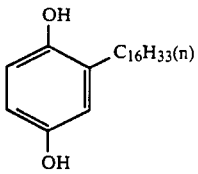
-continued
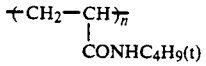
(Molecular weight: 80,000)
Color Image Stabilizer (Cpd-15):
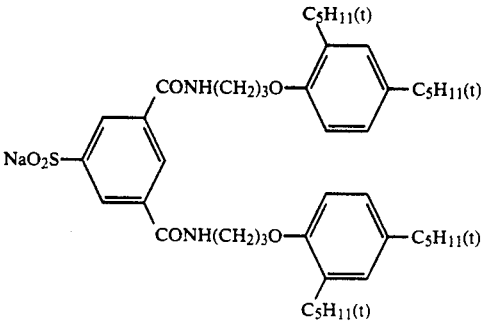
Color Image Stabilizer (Cpd-16):
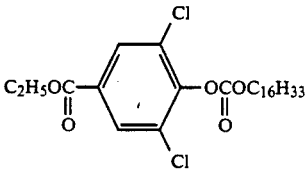
Solvent (Solv-5):
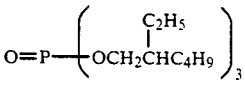
Solvent (Solv-6):
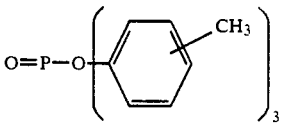
Solvent (Solv-7):
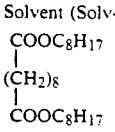
Solvent (Solv-8):
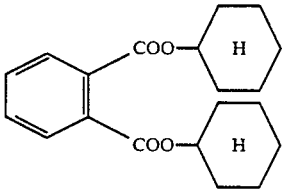
Solvent (Solv-9):
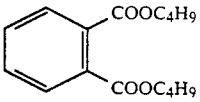
Solvent (Solv-10):
$O{=}P{\leftarrow}O{-}C_9H_{19}(iso))_3$
Ultraviolet Absorbent (UV-2):
4/2/4 (by weight) mixture of the following compounds.
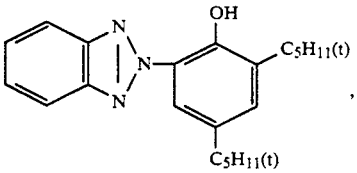
,
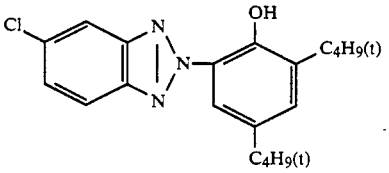
and
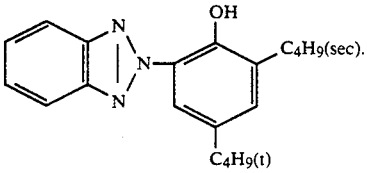
(Dye-a): As filter dye and for anti-irradiation -continued

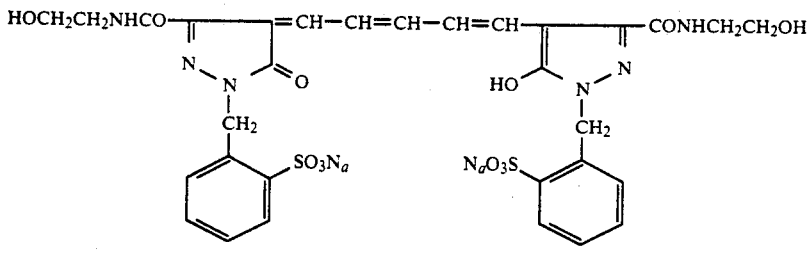

(Amount coated: 10 mg/m$^2$).

(Dye-b): As filter dye and for anti-irradiation

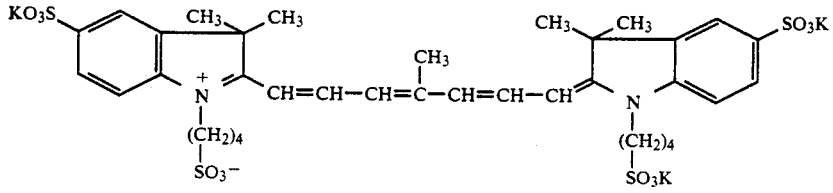

(Amount coated: 30 mg/m$^2$)

Dye 1:

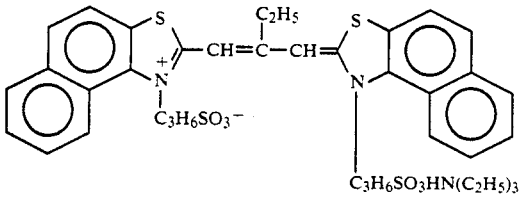

(Amount Coated: 3.2 × 10$^{-5}$ mol per mol of silver halide)

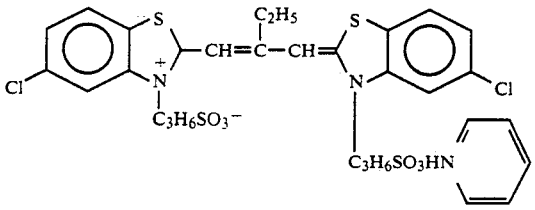

(Amount Coated: 2.7 × 10$^{-5}$ mol per mol of silver halide)

Dye 2:

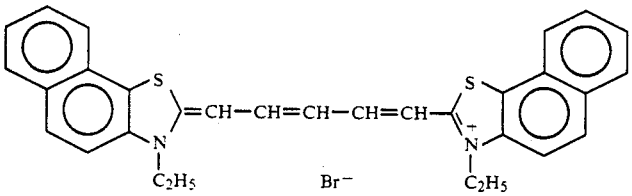

(Amount Added: 3.5 × 10$^{-5}$ mol per mol of silver halide)

The following (Cpd-17) was used together in an amount of 2.6×10$^{-3}$ mol/mol-Ag.

Dye 3:

-continued

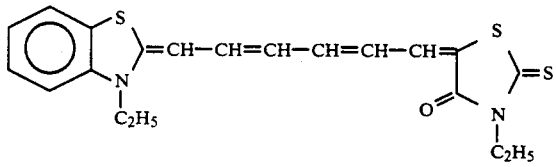

(Amount Added: 1.7 × 10$^{-5}$ mol per mol of silver halide)

The following (Cpd-17) was used together in an amount of 2.6×10$^{-3}$ mol/mol-Ag.

Dye 4:

-continued

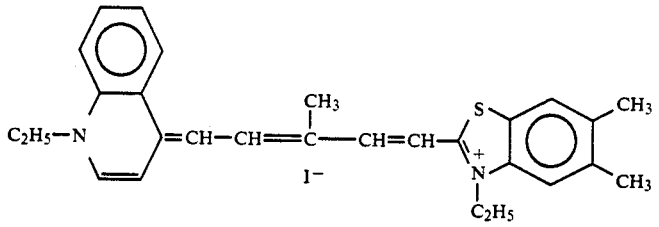

(Amount Added: $2.0 \times 10^{-5}$ mol per mol of silver halide)

The following (Cpd-17) was used together in an amount of $2.6 \times 10^{-3}$ mol/mol-Ag.

Dye 5:

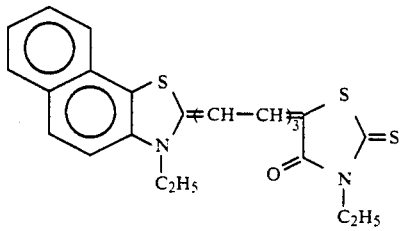

(Amount Added: $2.0 \times 10^{-5}$ mol per mol of silver halide)

The following (Cpd-17) was used together in an amount of $2.6 \times 10^{-3}$ mol/mol-Ag.

Dye 6:

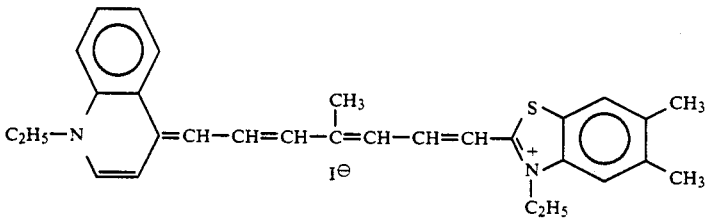

(Amount Added: $2.0 \times 10^{-5}$ mol per mol of silver halide)

The following (Cpd-17) was used together in an amount of $2.6 \times 10^{-3}$ mol/mol-Ag.

Cpd-1:

Disodium 4,4'-bis[2,6-di(2-naphthoxy)pyrimidin-4-ylamino]-stilbene-2,2'-disulfonate

TABLE 6

| Sample No. | Yellow Coloring Layer Emulsion Used | Yellow Coloring Layer Dye Used | Magenta Coloring Layer Emulsion Used | Magenta Coloring Layer Dye Used | Cyan Coloring Layer Emulsion Used | Cyan Coloring Layer Dye Used |
|---|---|---|---|---|---|---|
| 48* | 48 | Dye 1 | 48 | Dye 2 | 55 | Dye 3 |
| 49* | 48 | Dye 1 | 48 | Dye 2 | 56 | Dye 3 |
| 50** | 48 | Dye 1 | 48 | Dye 2 | 53 | Dye 3 |
| 51* | 48 | Dye 1 | 48 | Dye 2 | 54 | Dye 3 |
| 52** | 48 | Dye 1 | 48 | Dye 2 | 48 | Dye 3 |
| 53* | 48 | Dye 1 | 48 | Dye 2 | 49 | Dye 3 |
| 54** | 48 | Dye 1 | 48 | Dye 2 | 48 | Dye 4 |
| 55** | 48 | Dye 1 | 48 | Dye 2 | 48 | Dye 5 |
| 56** | 48 | Dye 1 | 48 | Dye 2 | 50 | Dye 3 |
| 57** | 48 | Dye 1 | 48 | Dye 2 | 51 | Dye 3 |
| 58** | 48 | Dye 1 | 48 | Dye 2 | 52 | Dye 3 |

*Comparison
**Invention

As an exposure apparatus, the following apparatus was used. A semiconductor laser AlGaInP (oscillating wavelength: about 670 nm), a semiconductor laser GaAlAs (oscillating wavelength: about 750 nm) and a semiconductor laser GaAlAs (oscillating wavelength: about 810 nm) were used as lasers. The laser ray-irradiating apparatus was so constructed that the laser ray may be applied to he color photographic paper as moving in the direction vertical to the scanning direction, by scanning exposure by the use of a rotating polyhedral rotor. For adjusting the exposure amount, the exposure time with the semiconductor lasers was electrically controlled.

Using the exposure apparatus, the samples were sensitometrically exposed, and the variation of the photographic properties between before and after the continuous processing was compared with each other. The results are shown in Table 7 below.

TABLE 7

| Sample No. | Photographic Properties: Yellow Coloration Dmax | Yellow Coloration Gradation | Magenta Coloration Dmax | Magenta Coloration Gradation | Cyan Coloration Dmax | Cyan Coloration Gradation |
|---|---|---|---|---|---|---|
| 48 | −0.02 | −0.02 | −0.02 | −0.02 | −0.20 | −0.12 |
| 49 | −0.02 | −0.02 | −0.03 | −0.02 | −0.23 | −0.15 |
| 50 | −0.02 | −0.02 | −0.02 | −0.02 | −0.05 | −0.03 |
| 51 | −0.02 | −0.02 | −0.02 | −0.02 | −0.15 | −0.13 |
| 52 | −0.02 | −0.02 | −0.03 | −0.02 | −0.03 | −0.02 |
| 53 | −0.02 | −0.02 | −0.02 | −0.02 | −0.18 | −0.13 |
| 54 | −0.02 | −0.02 | −0.02 | −0.02 | −0.03 | −0.02 |
| 55 | −0.02 | −0.02 | −0.02 | −0.02 | −0.03 | −0.02 |
| 56 | −0.02 | −0.02 | −0.02 | −0.02 | −0.01 | −0.01 |
| 57 | −0.02 | −0.02 | −0.02 | −0.02 | −0.01 | −0.01 |
| 58 | −0.02 | −0.02 | −0.02 | −0.02 | −0.01 | −0.01 |

[ ]: Scope of the Present Invention

As is obvious from the results in Table 7, the variation of the photographic properties of the samples of the present invention only was small before and after the continuous processing.

While the invention has been described in detail and with reference to specific embodiments thereof, it will be apparent to one skilled in the art that various changes and modifications can be made therein without departing from the spirit and scope thereof.

What is claimed is:

1. A method of forming a color dye image on a silver halide color photographic light-sensitive material having at least one silver halide emulsion layer provided on a reflective support, the silver halide emulsion layer contains a color coupler which reacts with the oxidation product of an aromatic amine developing agent to form a color dye, which silver halide emulsion layer does not substantially contain silver iodide and which contains silver chlorobromide or silver chloride grains having a silver chloride content of at least 98 mol %, said grains containing at least one metal ion selected from the group consisting of a group of ions of metals of Group VIII of the Periodic Table, transition metals of Group II of the Periodic Table, lead and thallium in an amount of at least $10^{-9}$ mol per mol of silver halide, comprising exposing said photographic material by means of a scanning layer exposure using an image signal formed by scanning an original image and thereafter continuously processing said photographic material with a color developer containing an aromatic amine developing agent and substantially not containing benzyl alcohol, wherein the amount of the replenisher to the developer is 200 ml or less per $m^2$ of the photographic material processed thereby, and said scanning exposure comprises carrying out said exposure using a light source comprising a semiconductor laser.

2. A method of forming a color image as in claim 1, wherein the silver chlorobromide grains have a silver bromide-locallized phase.

3. A method of forming a color image as in claim 2, wherein said silver bromide-locallized phase contains said metal ion.

4. A method of forming a color image as in claim 1, wherein said metal ion is selected from the group consisting of ions of iron, iridium, platinum, palladium, nickel and rhodium.

5. A method of forming a color image as in claim 2, wherein the silver bromide content in the silver bromide-locallized phase is from 10 to 70 mol %.

6. A method of forming a color image as in claim 1, wherein said silver halide grains are formed in the presence of said metal ion.

7. A method of forming a color image as in claim 1, wherein said metal ion is selected from the group consisting of ions of iron, iridium, platinum, palladium, nickel, rhodium, osmium, ruthenium, cobalt, cadmium, zinc, mercury, lead and thallium.

8. A method of forming a color image as in claim 1, wherein the amount of the metal ion is from $10^{-9}$ mol to $10^{-2}$ mol per mol of silver halide.

9. A method of forming a color image as in claim 1, wherein the amount of said metal ion is from $10^{-8}$ mol to $10^{-3}$ mol per mol of silver halide.

10. A method of forming a color image as in claim 1, wherein the emulsion contains at least one compound selected from the group consisting of compounds represented by the following formulae (IV) to (VI):

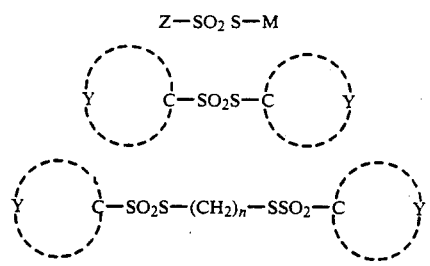

(IV)

(V)

(VI)

wherein

Z represents an alkyl group, an aryl group or a heterocyclic group, which may be further substituted;

Y represents an atomic group necessary for forming an aromatic ring or a hetero ring, which may be further substituted;

M represents a metal atom or an organic cation; and n represents an integer of from 2 to 10.

11. A method of forming a color image as in claim 1, wherein said scanning exposure comprises carrying out said exposure using a light source comprising a semiconductor laser and a wavelength-converting element composed of a nonlinear optical material.

12. A method of forming a color image as in claim 11, wherein the nonlinear optical material is a nitrogen-containing heterocyclic compound of general formula (A):

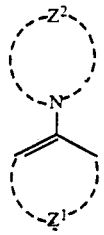

(A)

wherein $Z^1$ represents an atomic group necessary for forming a 5- or 6 membered aromatic ring having at least one nitro group as a substituent; and $Z^2$ represents an atomic group necessary for forming a pyrrol, imidazole, pyrazole, triazole or tetrazole ring, each of which may be substituted or ring-condensed.

13. A method of forming a color image as in claim 11, wherein the nonlinear optical material is a nitrogen-containing heterocyclic compound of general formula (B):

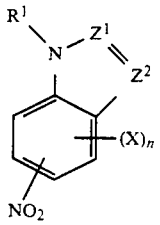

(B)

wherein $Z^1$ and $Z^2$ may be same or different and each represents a nitrogen atom or a group $CR^2$;

X represents an alkyl group, an aryl group, a halogen atom, an alkoxy group, an aryloxy group, an acylamino group, a carbamoyl group, a sulfamoyl group, an acyloxy group, an alkoxycarbonyl group, an aryloxycarbonyl group, an alkloxysulfonyl group, an aryloxysulfonyl group, an alkylthio group, an arylthio group, a hydroxyl group, a thiol group, a carboxyl group, a ureido group, a cyano group, an alkylsulfonyl group, an arylsulfonyl group, an alkylsulfinyl group, an arylsulfinyl group or a nitro group;

n represents 0 or an integer of from 1 to 3;

$R^1$ represents a hydrogen atom , an alkyl group, an aryl group, or an acyl group, which may be substituted; and $R^2$ represents a hydrogen, an alkyl group or an aryl group, each of which may be substituted.

14. A method of forming a color image as in claim 12, wherein the nonlinear optical material is at least one of the following PRA or TRI

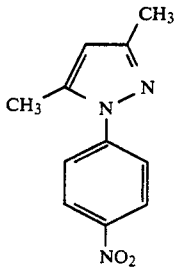

PRA

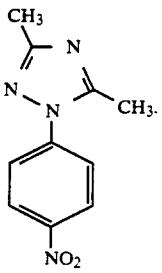

TRI

15. A method of forming a color image as in claim 1, wherein said method comprises incorporating said ion into the grains by adding said ion to the emulsion before or during formation of the grains or during physical ripening of the emulsion.

16. A method of forming a color image as in claim 1, wherein said method comprises incorporating said ion into the grains by incorporating said metal ion into fine silver halide grains, adding the fine silver halide grains to a host silver halide emulsion to dissolve the fine silver halide grains therein and thereby transferring the metal ion into the host silver halide grains in the emulsion.

* * * * *